US011231255B2

(12) United States Patent
Lavin et al.

(10) Patent No.: US 11,231,255 B2
(45) Date of Patent: Jan. 25, 2022

(54) METHODS AND APPARATUS FOR A CARTRIDGE USED WITH A CONDUCTED ELECTRICAL WEAPON

(71) Applicant: Axon Enterprise, Inc., Scottsdale, AZ (US)

(72) Inventors: Albert Lavin, Scottsdale, AZ (US); Luke Salisbury, Scottsdale, AZ (US); Milan Cerovic, Scottsdale, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 119 days.

(21) Appl. No.: 16/374,400

(22) Filed: Apr. 3, 2019

(65) Prior Publication Data

US 2019/0257622 A1 Aug. 22, 2019

Related U.S. Application Data

(63) Continuation of application No. 14/981,576, filed on Dec. 28, 2015, now Pat. No. 10,288,388.

(51) Int. Cl.
*F41H 13/00* (2006.01)

(52) U.S. Cl.
CPC ..... *F41H 13/0025* (2013.01)

(58) Field of Classification Search
CPC ..... F41H 13/0025
See application file for complete search history.

(56) References Cited

U.S. PATENT DOCUMENTS 3,742,814 A 7/1973 Kroh
5,467,247 A 11/1995 De Anda
5,831,199 A 11/1998 McNulty, Jr. et al.
6,360,645 B1 3/2002 McNulty, Jr. et al.
6,477,933 B1 11/2002 McNulty, Jr. et al.
6,575,073 B2 6/2003 McNulty, Jr. et al.
7,314,007 B2 1/2008 Su
7,444,939 B2 11/2008 McNulty et al.
7,520,081 B2 4/2009 Kroll
7,640,839 B2 1/2010 McNulty, Jr.
(Continued)

FOREIGN PATENT DOCUMENTS

KR 101872709 B1 7/2018
WO 2012128670 A2 3/2012

OTHER PUBLICATIONS

USPTO, Non-final Office Action for U.S. Appl. No. 14/981,576, dated Sep. 18, 2018.
(Continued)

*Primary Examiner* — Scott Bauer
(74) *Attorney, Agent, or Firm* — Justin Powley

(57) ABSTRACT

A cartridge for coupling to a conducted electrical weapon to launch electrodes toward a target to provide a current through the target to impede locomotion of the target. The cartridge includes a cover that covers a forward portion of the cartridge. The cover may be over molded on the forward portion of the cartridge. The cover includes a frangible portion. The frangible portion may surround the perimeter of a door or be positioned between flaps. The frangible portion may be broken to separate the door from the cover or to disengage the flaps so they can move. The electrode may launch through a door opening or between the flaps to travel toward the target.

20 Claims, 11 Drawing Sheets

(56) References Cited

U.S. PATENT DOCUMENTS

| | | | | |
|---|---|---|---|---|
| 7,891,127 | B2 | 2/2011 | Cerovic | |
| 8,015,905 | B2 | 9/2011 | Park | |
| 8,733,251 | B1 * | 5/2014 | Abboud | F41H 13/0012 102/502 |
| 9,080,840 | B2 | 7/2015 | Klug | |
| 9,267,768 | B1 | 2/2016 | Chang | |
| 9,518,727 | B1 | 12/2016 | Markle et al. | |
| 10,288,388 | B1 * | 5/2019 | Lavin | F41H 13/0025 |
| 2005/0024807 | A1 * | 2/2005 | Cerovic | F41C 3/00 361/232 |
| 2006/0254108 | A1 | 11/2006 | Park | |
| 2009/0323248 | A1 * | 12/2009 | Brundula | F41A 17/066 361/232 |
| 2010/0146835 | A1 * | 6/2010 | McNulty, Jr. | F41B 15/04 42/1.08 |
| 2014/0334058 | A1 | 11/2014 | Galvan et al. | |

OTHER PUBLICATIONS

USPTO, Notice of Allowance and Fee(s) Due for U.S. Appl. No. 14/981,576, dated Jan. 8, 2019.

* cited by examiner

METHODS AND APPARATUS FOR A CARTRIDGE USED WITH A CONDUCTED ELECTRICAL WEAPON

CROSS-REFERENCE TO RELATED APPLICATIONS

This application claims priority to non-provisional patent application Ser. No. 14/981,576 filed Dec. 28, 2015 which is incorporated herein by reference in its entirety.

FIELD OF THE INVENTION

Embodiments of the present invention relate to a conducted electrical weapon ("CEW") that launches electrodes to provide a current through a human or animal target to impede locomotion of the target.

BRIEF DESCRIPTION OF THE DRAWING

Embodiments of the present invention will be described with reference to the drawing, wherein like designations denote like elements, and.

DETAILED DESCRIPTION OF THE PREFERRED EMBODIMENTS

Figure 1:
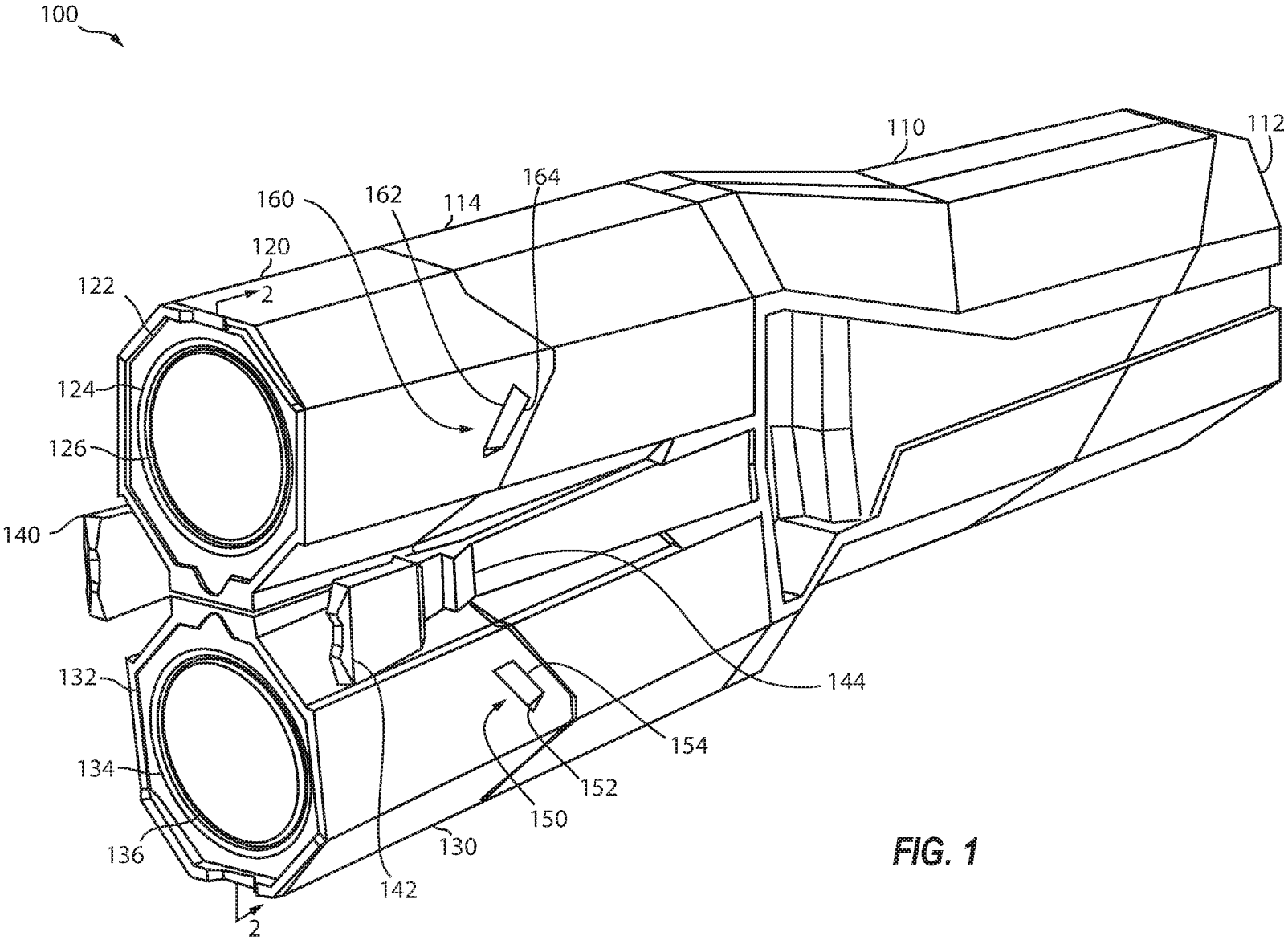
FIG. 1 is a perspective view of an implementation of the cartridge of FIG. 10.
Figure 2:
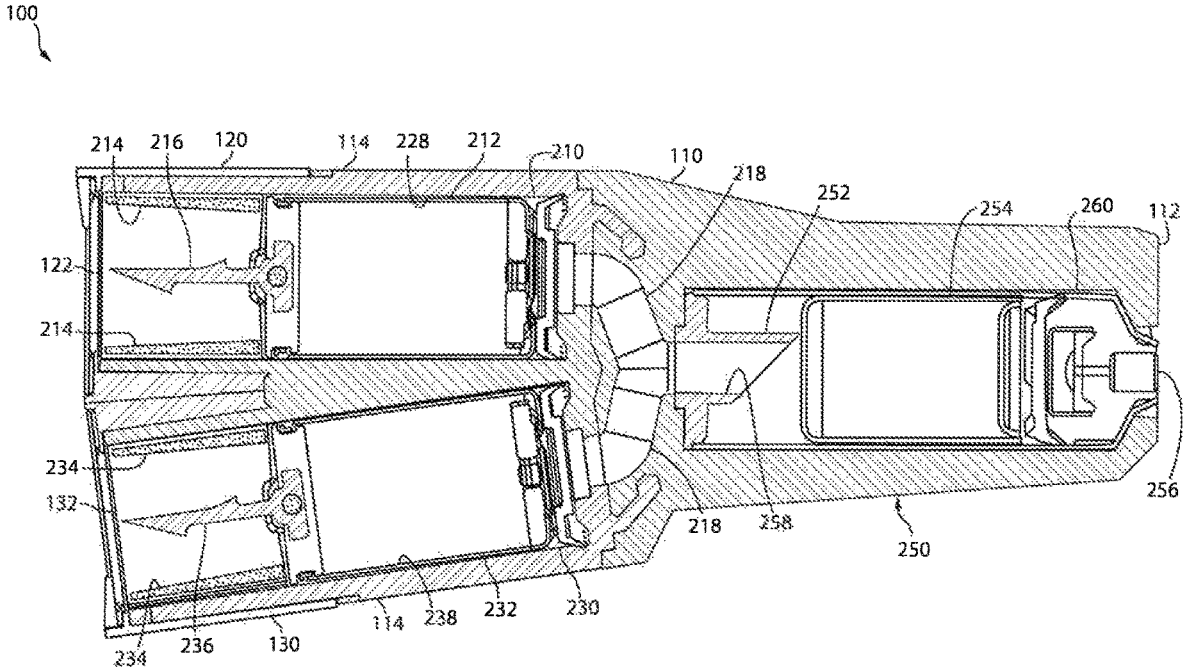
FIG. 2 is a cross-section view of the cartridge of FIG. 1 along 2-2.
Figure 3:
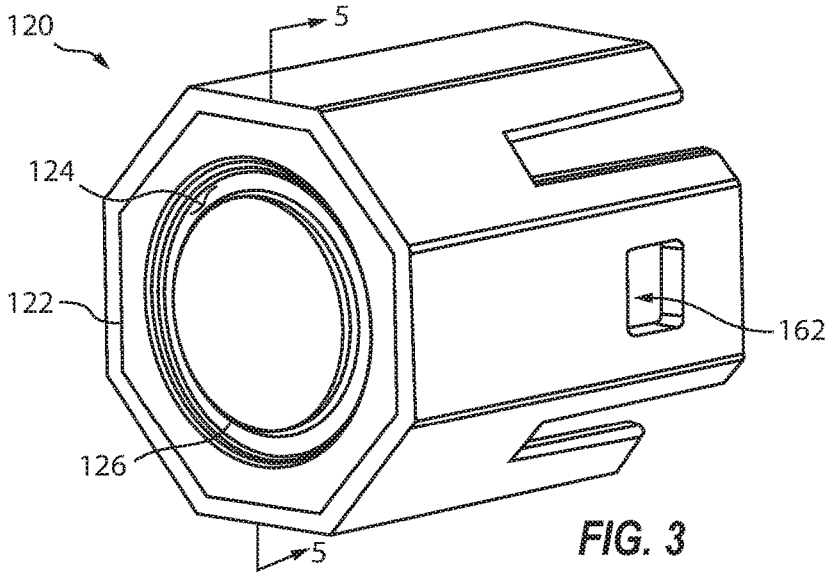
FIG. 3 is a perspective view of a cap from the cartridge of FIG. 1.
Figure 4:
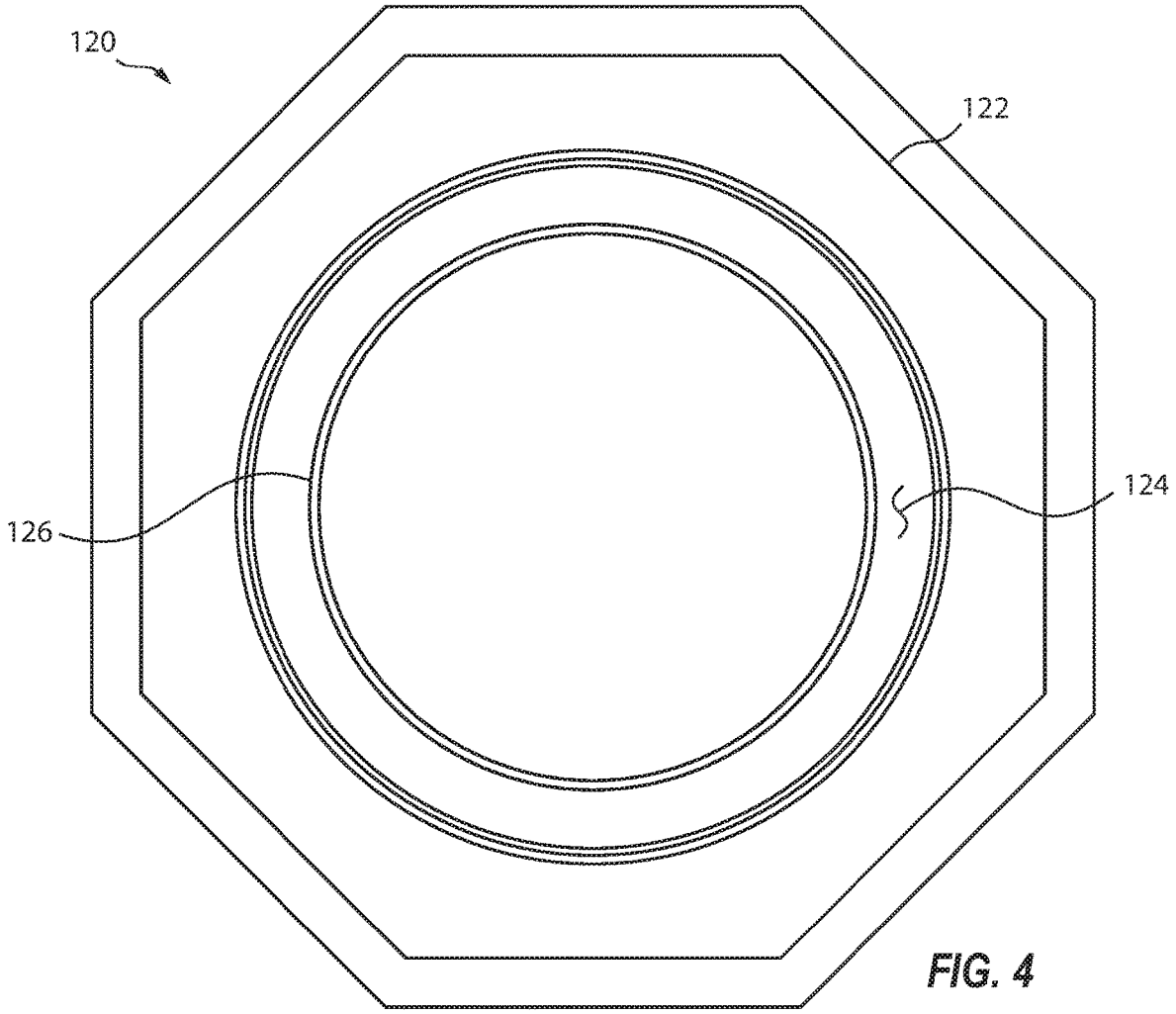
FIG. 4 is a front view of the cap of FIG. 3.
Figure 5:
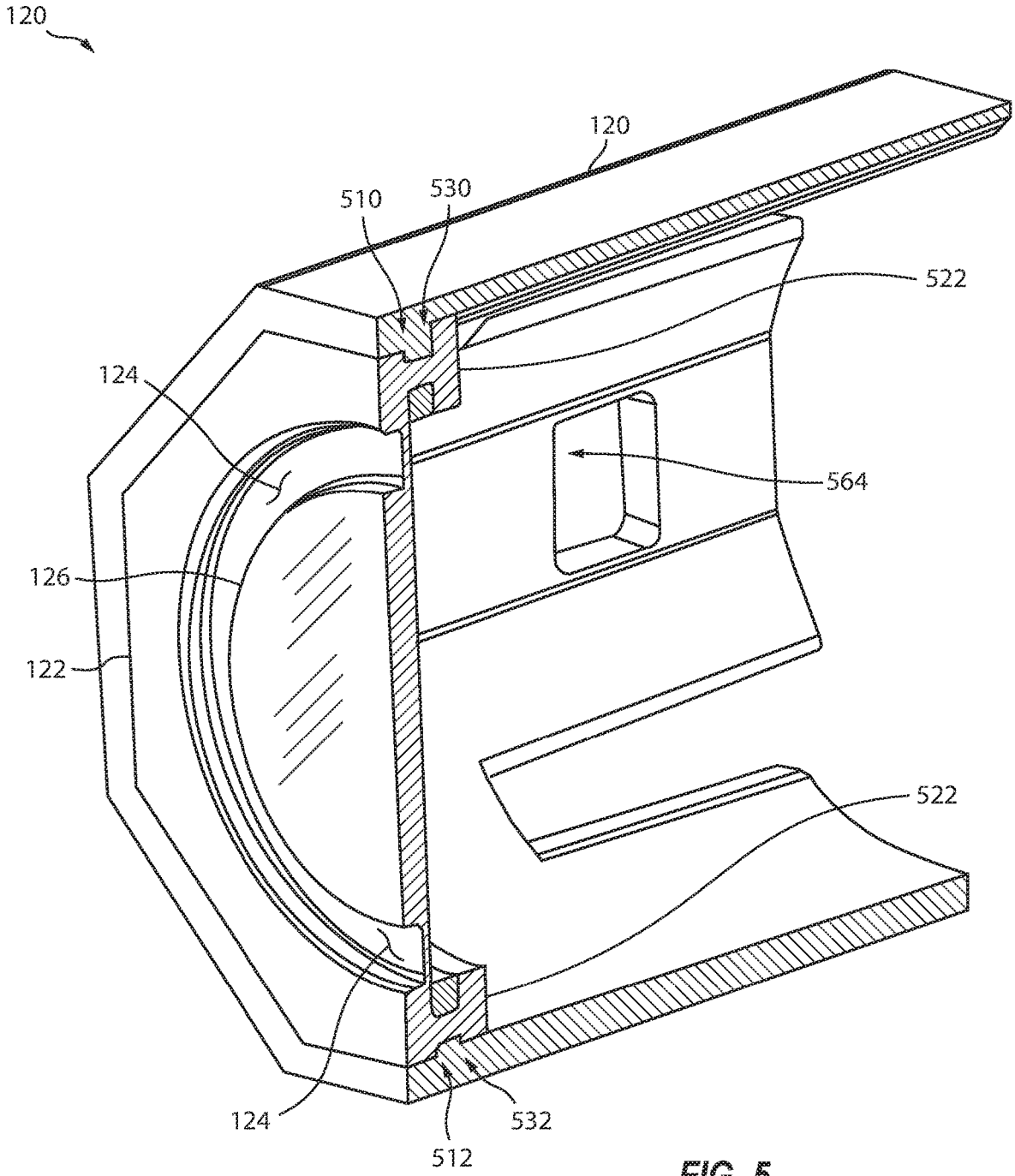
FIG. 5 is a cross-section view of the cap of FIG. 3 along 5-5.
Figure 6:
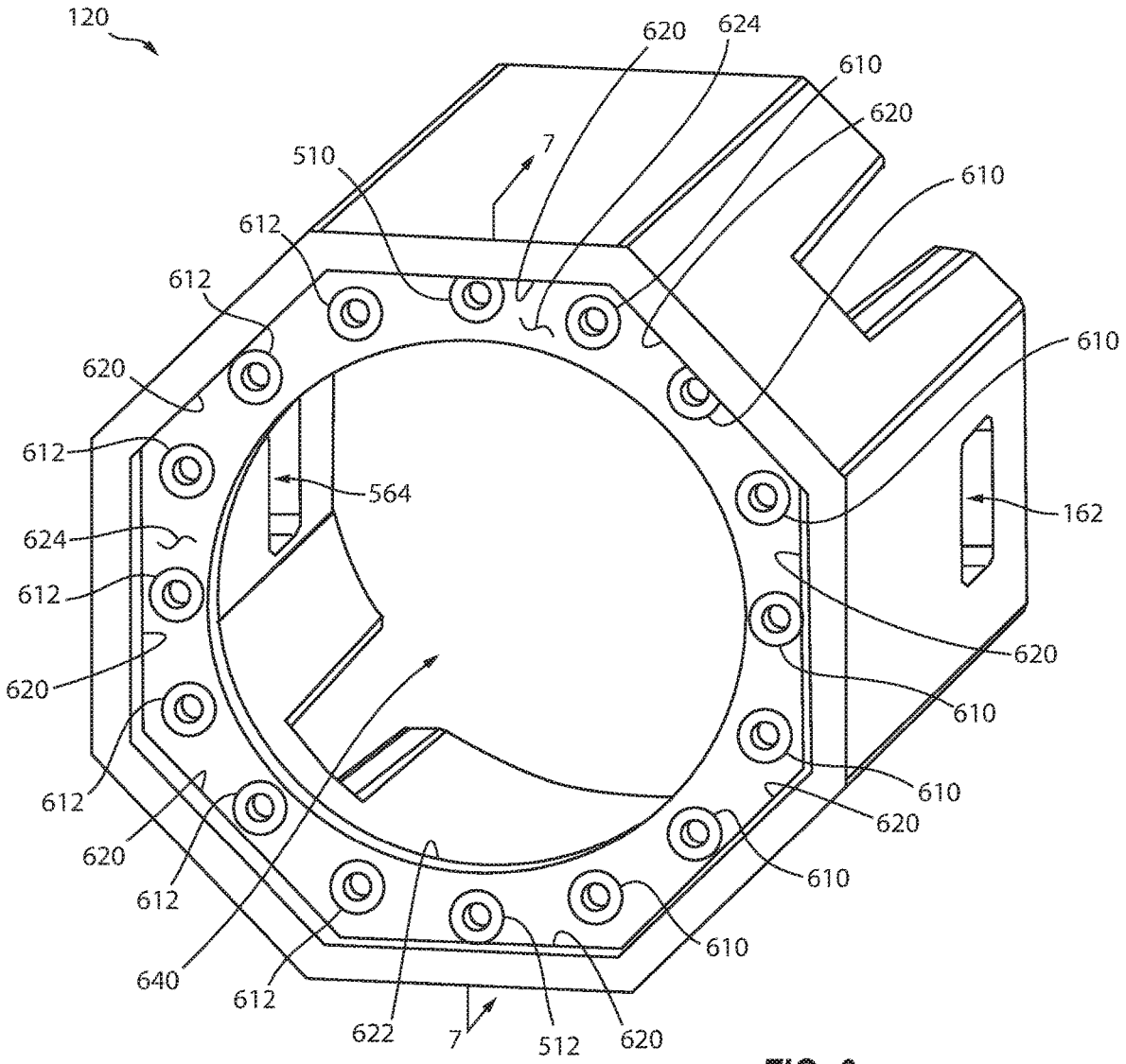
FIG. 6 is a perspective view of the cap of FIG. 3 with the cover removed.
Figure 7:
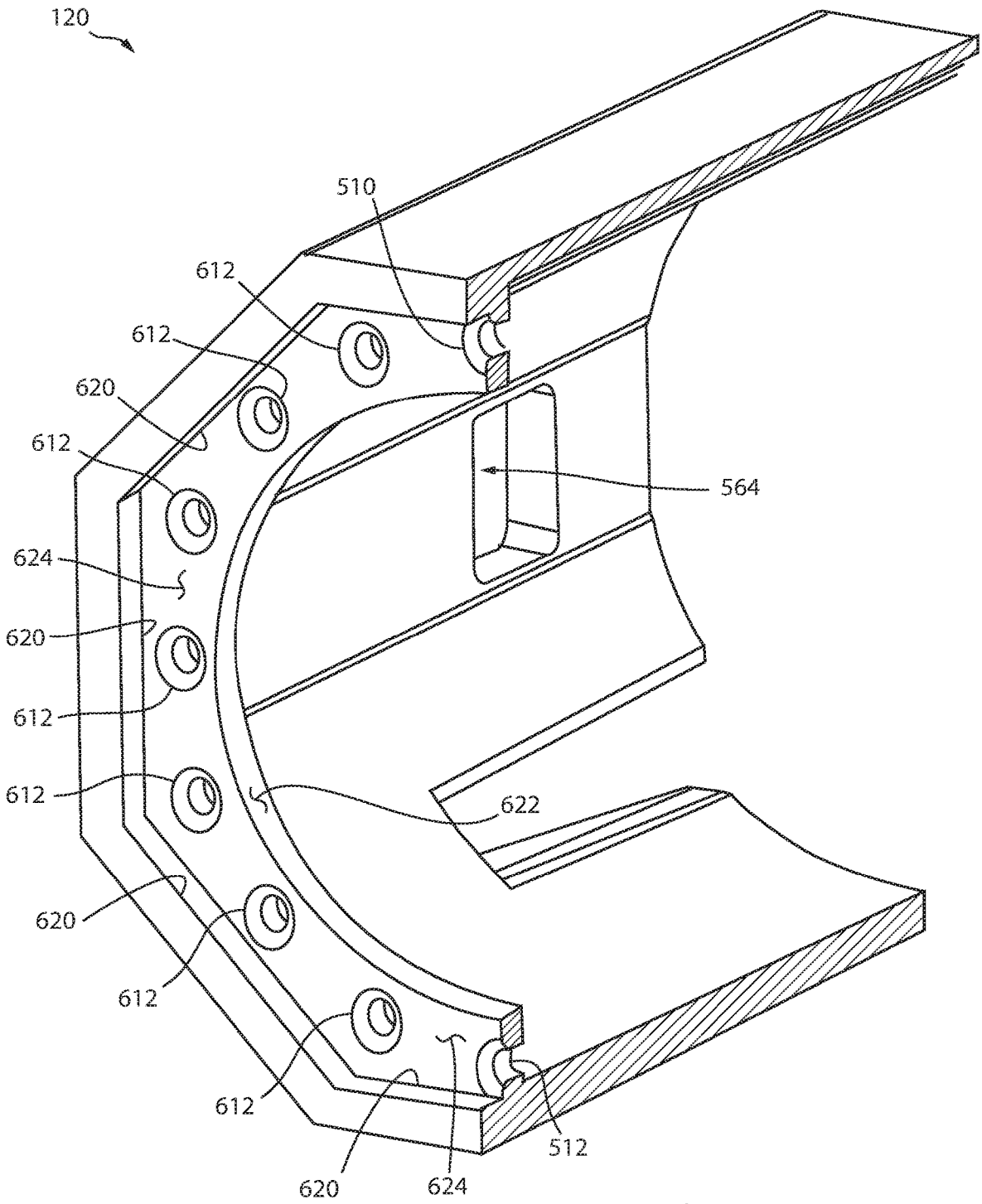
FIG. 7 is a cross-section view of the cap of FIG. 6 along 7-7.
Figure 8:
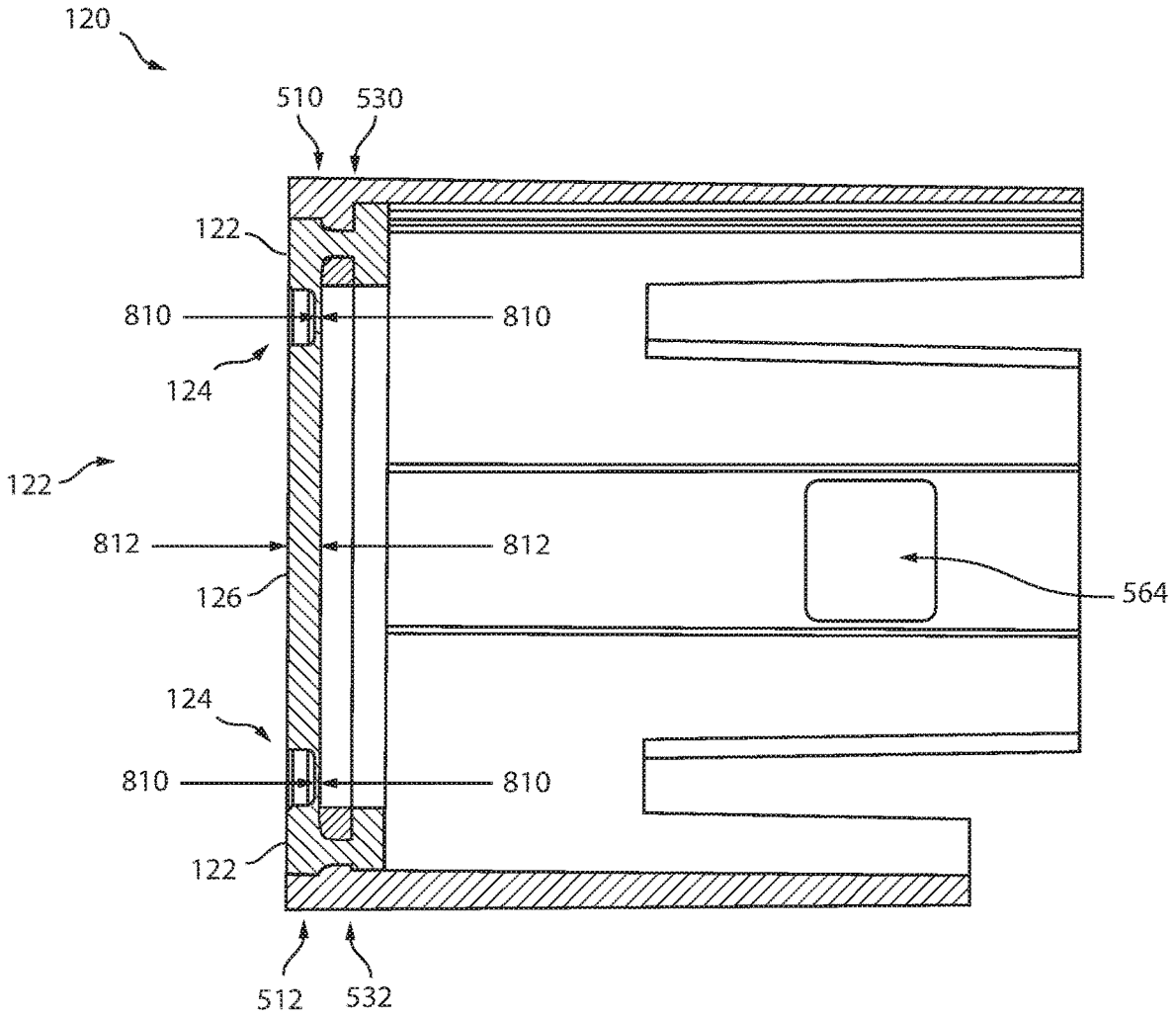
FIG. 8 is a cross-section view of FIG. 5 rotated into the page to provide a side cross-section view.
Figure 9:
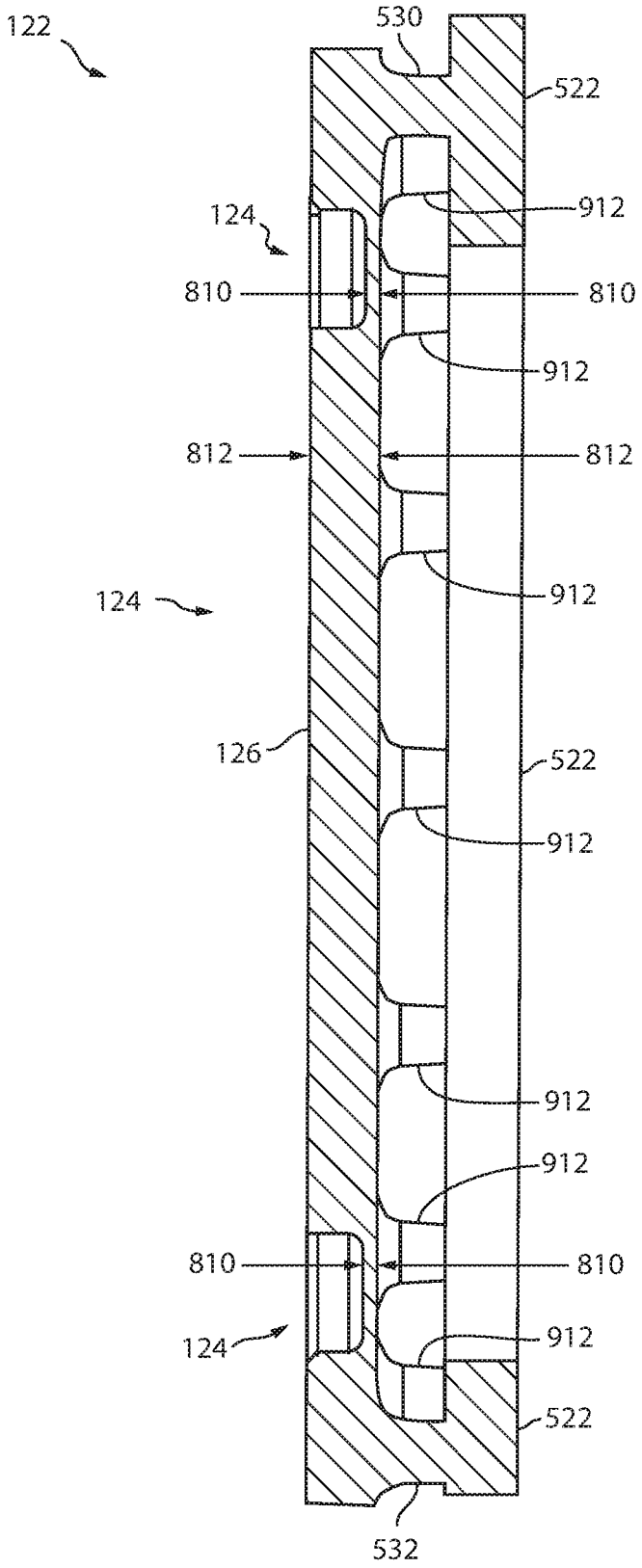
FIG. 9 is a cross-section view of the cover only of FIG. 5 rotated into the page to provide a side cross-section view.

A CEW provides (e.g., delivers) a current through tissue of a human or animal target. The current may interfere with voluntary locomotion (e.g., walking, running, moving) of the target. The current may cause pain that encourages the target to stop moving. The current may cause skeletal muscles of the target to become stiff (e.g., lock up, freeze, spasm, cramp) so as to disrupt voluntary control of the muscles (e.g., neuromuscular incapacitation) by the target thereby interfering with voluntary locomotion by the target.

A current may be delivered through a target via one or more electrodes that are tethered by respective wires (e.g., filaments) to the CEW. Delivery via wire-tethered electrodes is referred to as remote delivery because the CEW, and user of the CEW, may be separated from the target up to the length of the filament to deliver the current through the target. To provide remote delivery of a current, the user operates the CEW to launch one or more, usually two, electrodes toward the target. The electrodes fly (e.g., travel) from the CEW toward the target while the respective wire tethers extend behind the electrodes. The wire tethers electrically couple the CEW to the electrode. The electrode may electrically couple to the target thereby coupling the CEW to the target. When one or more electrodes land on or proximate to target tissue, the current is provided through the target via the one or more electrodes and their respective filaments.

Conventional CEWs launch at least two wire-tethered electrodes to remotely deliver a current through a target. The at least two electrodes land on (e.g., impact, hit, strike) on proximate to target tissue to form a circuit through a first tether, a first electrode, target tissue, a second tether, and a second electrode. The circuit is electrically coupled to a signal generator of the CEW that provides the current through the target via the circuit.

In an implementation, an electrode launched by the CEW has a body and a spear mechanically coupled to the body. The body has a substantially cylindrical shape with the spear mechanically coupled to a forward end of the cylinder. The cylinder is about between 0.458 and 0.465 inches in diameter. The electrode, including the spear and body is about 1.23 inches in length. A wire (e.g., wire, filament) tethers the electrode to the CEW to provide the current through the target. The wire is stored inside the body of the electrode prior to launching the electrode. The electrode weighs about 5 grams while the wire is inside the body of the electrode. An electrode is launched from the CEW at a speed of between 120 to 150 feet per second.

A CEW according to various aspects of the present invention includes a handle and one or more cartridges (e.g., cartridges). The one or more cartridges may be removably coupled to the handle. A handle may include one or more bays for receiving cartridges. A cartridge may include, inter alia, electrodes that are launched toward a target and the wire tethers that electrically and mechanically couple the electrode to the handle. Typically, a cartridge includes two electrodes that are launched at the same time. A cartridge may be inserted into a bay of the handle. After the electrodes of the cartridge have been launched toward a target, the electrodes and wire tethers may be used to provide a current through the target one or more times, but the cartridge cannot be used to relaunch the electrodes toward the same or a different target. After a cartridge has launched its electrodes it is used (e.g., spent, fired, expended). A used cartridge may be removed from a bay of the handle and disposed. A new (e.g., unused) cartridge may be inserted into a bay of the handle to launch additional electrodes toward the same or different target.

Conventional cartridges prior to firing are closed to protect the electrodes and other components in the cartridge. In an unfired cartridge, the electrodes are not visible to a user. The closed environment of the cartridge protects the electrode and other components from damage during storage and transport before use. For example, in the event that a cartridge is dropped before use, the cartridge housing protects the electrodes and other components so that the cartridge likely may be used.

In order to launch an electrode from a cartridge, the cartridge must be opened so that the electrodes are uncovered and accessible to permit the electrode to exit the cartridge. In conventional cartridges, the force that launches the electrode is also used to force open the cartridge to permit the electrode to exit. In one conventional design, a ram positioned forward of the electrode is pushed by the force of launch against a cover (e.g., lid) of the cartridge to break the cover so that it may be removed from the cartridge. Opening the cover of the cartridge may affect the trajectory of launch of the electrode. Due to manufacturing tolerances and variations, the force necessary to open or break a cover of a conventional cartridge may vary from one cartridge to the next. Variations in the force needed to open the cover leads to variability in the resulting trajectory of the electrode. Variability in the trajectory results in variability in the accuracy of delivery of the electrodes to a target.

Another factor that affects the precision of launch of an electrode is the reaction of the cover of the cartridge to the force required to open (e.g., remove) the cover from the cartridge. In the conventional design discussed above, as the ram exits the cartridge, it moves the now broken cover out of the flight path of the electrode. However, in some instances, a portion of the cover strikes an outer portion of the cartridge so that the cover rebounds back into the path of the electrode thereby altering the flight path of the electrode and decreasing accuracy.

Another factor that affects the precision of launch of an electrode from a conventional cartridge is any possible interaction between the cover as it is being removed and the wire tether as it is being deployed. Contact between the cover and the wire tether may also affect the accuracy of the flight of the electrode. As discussed above, in one conventional design, the cover (e.g., lid) of a cartridge is opened by breaking the cover and pushing it away from the cartridge. If the cover rebounds, it can strike the wire tether as it is being deployed thereby affecting the accuracy of flight of the electrode. If the cover strikes (e.g., contacts, interferes with) the wire tether as the cover opens, the interference may affect the accuracy of flight of the electrode.

According to various aspects of the present invention, decreasing the variability of the force required to open the cover (e.g., lid) of a cartridge, the likelihood of rebound of the cover into the path of the electrode, and/or possible interference between the cover and the wire tether increases the accuracy of the flight of the electrode from the cartridge and the accuracy of delivery of the electrode in or near target tissue.

Upon reaching (e.g., striking, hitting) a target, an electrode may be separated from target tissue by the target's clothing or a gap of air. A signal generator of the CEW may provide a signal (e.g., stimulus signal, current, pulses of current) at a high voltage, in the range of 40,000 to 100,000 volts, to ionize the air in the clothing or the air in the gap that separates the electrode from target tissue. Ionizing the air establishes a low impedance ionization path from the electrode to target tissue that may be used to deliver a current into target tissue. After ionization, the ionization path will persist (e.g., remain in existence) as long as a current is provided via the ionization path. When the current provided by the ionization path ceases or is reduced below a threshold (e.g., amperage, voltage), the ionization path collapses (e.g., ceases to exist) and the electrode is no longer electrically coupled to target tissue because the impedance between the electrode and target tissue is high. A high voltage in the range of about 50,000 volts can ionize air in a gap of up to about one inch.

In an implementation of a CEW, according to various aspects of the present invention, CEW 1100 includes handle 1110 and cartridges 1120 and 1130. Handle 1110 includes, inter alia, a user interface that includes trigger 1140 and safety 1142, power supply 1150, processing circuit 1160, signal generator 1170, bay 1180, and bay 1190. A handle may be shaped for ergonomic use by a user. Conventional CEWs are shaped like conventional fire arms such as a pistol. Although an embodiment of a CEW includes a pistol-like device, a CEW that includes the improvements of the present invention may be implemented as a night stick, a club, a rifle, a projectile, or in any other suitable form factor.

Figure 10:
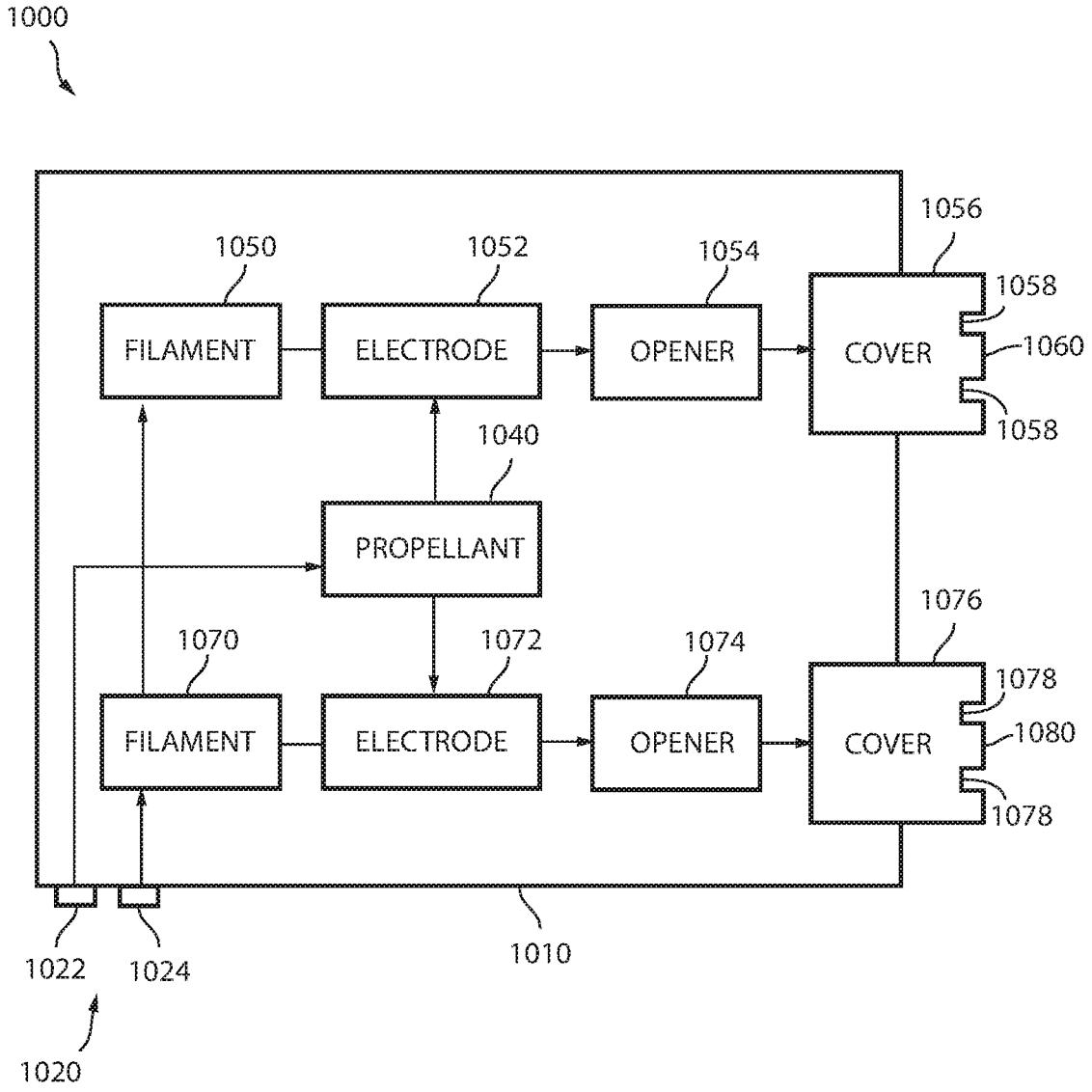
FIG. 10 is a functional diagram of a cartridge for use with a handle of a conducted electrical weapon ("CEW") according to various aspects of the present invention.

Cartridge 1120 includes, inter alia, wire tethers 1122 and 1126, and electrodes 1124 and 1128. Cartridge 1130 includes, inter alia, wire tethers 1132 and 1136, and electrodes 1134 and 1138. A functional diagram of a cartridge, according to various aspects of the present invention, is provided in FIG. 10. The drawing of cartridge 1000 discloses additional components of a cartridge that are not shown in the implementation of cartridges 1120 and 1130 in FIG. 11.

A cartridge may include, according to various aspects of the present invention, housing 1010, propellant 1040, filaments 1050 and 1070, electrodes 1052 and 1072, openers 1054 and 1074, covers 1056 and 1076, and coupler 1020. Coupler 1020 includes contact 1022 and contact 1024. Cover 1056 includes door 1060 and frangible portion 1058. Cover 1076 includes door 1080 and frangible portion 1078.

A power supply provides power (e.g., energy). For a CEW, a power supply provides electrical power. Providing electrical power may include providing a current at a voltage. Electrical power from a power supply may be provided as a direct current ("DC"). Electrical power from a power supply may be provided as an alternating current ("AC"). A power supply may include a battery. A power supply may provide energy for performing the functions of a CEW. A power supply may provide the energy for a current that is provided through a target to impede locomotion of the target. A power supply may provide energy for operating the electronic and/or electrical components (e.g., parts, subsystems, circuits) of a CEW and/or one or more cartridges.

The energy of a power supply may be renewable or exhaustible. A power supply may be replaceable. The energy from a power supply may be converted from one form (e.g., voltage, current, magnetic) to another form to perform the functions of a CEW.

For example, power supply 1150 provides power for the operation of trigger 1140, safety 1142, signal generator 1170, and processing circuit 1160. Power supply 1150 provides the energy for a current for delivery through a target to impede locomotion of the target. The current delivered through a target may be provided via filaments 1122, 1126, 1132, and/or 1136, and electrodes 1124, 1128, 1134, and/or 1138.

A user interface may include one or more controls (e.g., trigger 1140, safety 1142) that permit a user to interact and/or communicate with a CEW. Via a user interface, a user may control (e.g., influence) the operation (e.g., function) of a CEW. A user interface may include any suitable device for operation by a user to control the operation of a CEW. A user interface may include controls. A control includes any electromechanical device suitable for manual manipulation (e.g., operation) by a user. A control includes any electromechanical device for operation by a user to establish or break an electrical circuit. A control may include a portion of a touch screen. A control may include a switch. A switch may include a pushbutton switch, a rocker switch, a key switch, a detect switch, a rotary switch, a slide switch, a snap action switch, a tactile switch, a thumbwheel switch, a push wheel switch, a toggle switch, and a key lock switch (e.g., switch lock). Operation of a control may occur by the selection of a portion of a touch screen.

Operation of a control may provide information to a device. Operation of a control of the user interface may result in performance of a function, halting performance of a function, resuming performance of a function, and/or suspending performance of a function of the CEW.

The term "control", in the singular, represents a single electromechanical device for operation by a user to provide information to a CEW. The term "controls", in plural, represents a plurality of electromechanically devices for operation by a user to provide information to a CEW. The term "controls" include at least a first control and a second control.

A processing circuit may detect the operation of a control. A processing circuit may perform a function of the CEW responsive to detecting operation of a control. A processing circuit may perform a function, halt a function, resume a function, and/or suspend a function of the CEW responsive to operation of one or more controls. A control may provide analog and/or binary information to a processing circuit. Operation of a control includes operating an electromechanical device or selecting a portion of a touch screen.

The function performed by a CEW responsive to operation of a control may depend on the present operating state (e.g., present state of operation, present function being performed) of the CEW. For example, if a CEW is presently performing function 1, operating a specific control may result in the device performing function 2. If the device is presently performing function 2, operating the same control again may result in the device performing function 3 as opposed to performing function 1 again.

A user interface may provide information to a user. A user may receive visual and/or audible information from a user interface. A user may receive visual information via devices that visually display (e.g., present, show) information (e.g., LCDs, LEDs, light sources, graphical and/or textual display, display, monitor, touchscreen). A user interface may include a communication circuit for transmitting information to an electronic device (e.g., smart phone, tablet) for presentation to a user.

For example, CEW 1100 includes controls 1140 (e.g., trigger) and 1142 (e.g., safety). Control 1142 is a switch that performs the function of a safety. When control 1142 is enabled, CEW 1100 cannot launch electrodes or provide a current via electrodes. When control 1142 is disabled (e.g., off), CEW 1100 may launch electrodes and provide a current via the electrodes. Control 1140 is a switch that performs the function of a trigger. When control 1142 is disabled and control 1140 is operated (e.g., pulled), CEW 1100 begins the process of providing a current for disabling a target and/or launching electrodes to provide the current. Controls 1140 and 1142 are a part of the user interface of CEW 1100. CEW 1100 may include other controls and/or a display as part of the user interface of CEW 1100.

A processing circuit includes any circuitry and/or electrical or electronic component for performing a function. A processing circuit may include circuitry that performs (e.g., executes) a stored program. A processing circuit may include a digital signal processor, a microcontroller, a microprocessor, an application specific integrated circuit, a programmable logic device, logic circuitry, state machines, MEMS devices, signal conditioning circuitry, communication circuitry, a conventional computer, a conventional radio, a network appliance, data busses, address busses, and/or any combination thereof in any quantity suitable for performing a function and/or executing one or more stored programs.

A processing circuit may include conventional passive electronic devices (e.g., resistors, capacitors, inductors) and/or active electronic devices (op amps, comparators, analog-to-digital converters, digital-to-analog converters, programmable logic, SRCs, transistors). A processing circuit may include conventional data buses, output ports, input ports, timers, memory, and arithmetic units.

A processing circuit may provide and/or receive electrical signals whether digital and/or analog in form. A processing circuit may provide and/or receive digital information via a conventional bus using any conventional protocol. A processing circuit may receive information, manipulate the received information, and provide the manipulated information. A processing circuit may store information and retrieve stored information. Information received, stored, and/or manipulated by the processing circuit may be used to perform a function, control a function, and/or to perform a stored program.

A processing circuit may have a low power state in which only a portion of its circuits operate or the processing circuit performs only certain function. A processing circuit may be switched (e.g., awoken) from a low power state to a higher power state in which more or all of its circuits operate or the processing circuit performs additional functions or all of its functions.

A processing circuit may control the operation and/or function of other circuits and/or components of a system such as a CEW. A processing circuit may receive status information regarding the operation of other components, perform calculations with respect to the status information, and provide commands (e.g., instructions) to one or more other components for the component to start operation, continue operation, alter operation, suspend operation, or cease operation. Commands and/or status may be communicated between a processing circuit and other circuits and/or components via any type of bus including any type of conventional data/address bus.

A signal generator provides a signal (e.g., stimulus signal). A signal may include a current. A signal may include a pulse of current. A signal may include a series (e.g., number) of current pulses. The signal provide by a signal generator may electrically couple a CEW to a target. A signal generator may provide a signal at a voltage of sufficient magnitude to ionize air in one or more gaps in series with the signal generator and a target to establish one or more ionization paths to sustain delivery of a current through the target as discussed above. The signal provided by a signal generator may provide a current through target tissue to interfere with (e.g., impede) locomotion of the target. A signal generator may provide a signal at a voltage to impede locomotion of a target by inducing fear, pain, and/or an inability to voluntary control skeletal muscles as discussed above. A signal that accomplishes electrical coupling and/or interference with locomotion of a target may be referred to as a stimulus signal.

A stimulus signal, as discussed above, may include one or more pulses of current. A pulse of current may be provided at one or more magnitudes of voltage and/or a combination of different voltage magnitudes. A pulse of current may accomplish electrical coupling and impeding locomotion as discussed above. A current pulse of a stimulus signal may include a high voltage portion for ionizing gaps of air to establish electrical coupling and a lower voltage portion for providing current through target tissue to impede locomotion of the target. A portion of the current used to ionize gaps of air to establish electrical connectivity may also contribute to the current provide through target tissue to impede locomotion of the target.

A stimulus signal may include a series of current pulses. Pulses may be delivered at a pulse rate (e.g., 22 pps) for a period of time (e.g., 5 second). One or more stimulus signals, or in other words one or more series of pulses, may be applied to a target to impede locomotion by the target. Each pulse of a stimulus signal may be capable of establishing electrical connectivity (e.g., ionizing air in one or more gaps) and interfering with locomotion of the target by passing through a circuit that includes target tissue.

A signal generator includes circuits for receiving electrical energy and for providing the stimulus signal. Electrical/electronic circuits (e.g., components) of a signal generator may include capacitors, resistors, inductors, spark gaps, transformers, silicon controlled rectifiers ("SCRs"), and analog-to-digital converters. A processing circuit may cooperate with and/or control the circuits of a signal generator to produce a stimulus signal.

A signal generator may receive electrical energy from a power supply. A signal generator may convert the energy from one form of energy into a stimulus signal for ionizing gaps of air and interfering with locomotion of a target. A processing circuit may cooperate with and/or control a power supply in its provision of energy to a signal generator. A processing circuit may cooperate with and/or control a signal generator in converting the received electrical energy into a stimulus signal.

A housing establishes an outer shape of a cartridge. A housing provides structure for mounting components (e.g., propellant, filament, electrode, opener, cover, coupler) of a cartridge inside and outside of the housing. A housing may be formed primarily of a rigid material for establishing the shape and structure of the cartridge. A housing may include materials that are pliable. A housing may protect the components of a cartridge during storage, transport, and/or use. A housing may protect the components of a cartridge from damage as a result of a shock (e.g., dropping cartridge) and/or the elements to some extent.

A housing may include one or more bores (e.g., tubes, cavity) for housing one electrode for each bore respectively. An opening (e.g., aperture) of a bore may be positioned on a forward (e.g., front) portion of the housing. A housing may include structures (e.g., ducts, tubes) for channeling (e.g., directing) a force of a propellant against an electrode in a bore to launch the electrode. A rear portion of a bore may include an opening for receiving the force provided by a propellant for launching the electrode from the bore. Travel by an electrode along a bore during launch may establish an initial trajectory of the electrode.

A cover may couple to a housing to cover the openings of the one or more bores. A cover may protect the electrodes during storage, transport, and/or use prior to firing. A cover may resist movement of an electrode from a bore until a magnitude of the force from the propellant reaches a minimum. A cover may include a door that opens when the cartridge is fired to permit an electrode to exit a bore during launch.

An opener (e.g., ejector) may cooperate with a frangible portion of a cover to open and/or remove a door of the cover to permit the electrode to launch from the cartridge. During launch, movement of an electrode may apply a force on an opener. An opener may in turn apply a force on a frangible portion of a cover. An opener may cooperate with the frangible portion of a cover to cut (e.g., slice, break, rupture, tear, separate) the frangible portion of the cover. Rupturing the frangible portion of the cover decouples (e.g., detaches) the door from the cover. After the frangible portion of the cover is ruptured, the opener may cooperate with the door to move the door out of the flight path (e.g., trajectory) of the electrode that is exiting (e.g., launching from) the cartridge. The door may be completely (e.g., entirely) removed from the cover so that no portion of the door remains coupled to the cover.

The area (e.g., surface area) of the door may be less than the area of the cover, so that removing the door from the cover detaches only a portion of the cover and leaves the remainder of the cover intact and attached to the cap.

An opener may include a device positioned between an electrode and a cover of the cartridge. An opener may be positioned in a bore forward of an electrode. Forward movement of an electrode may apply a force on the opener that results in forward movement of the opener. Forward movement of the opener may bring the opener into contact with the cover and in particular with a frangible portion and/or a door of the cover.

An opener may include structure for rupturing the frangible portion of a cover. An opener may include structure for pushing a door from a flight path of an electrode. An opener may include structures that separate after launch of an electrode. Such structures may facilitate movement of the opener from the flight path of the electrode during launch. The material that forms a door and/or an opener may have one or more characteristics (e.g., light weight, low mass, low density) that increase the likelihood that the door and the opener will move out of the flight path of an electrode during launch. An opener and/or a door may include structures that increase the transfer of the force provided by air resistance to the opener and/or door to move the opener and/or door out of the flight path of an electrode during launch.

An opener maintains the electrode, and in particular the tip of the spear of the electrode, away from the cover and the door of the cover prior to launch and while the opener opens the door of the cover. The opener keeps the electrode from contact with the door or cover in the event that the cartridge is dropped or thrown so that the tip of the spear does not destroy the integrity of the cover.

The dimensions of the frangible portion of the cover and/or the door may be slightly larger than the dimensions of an electrode so that the electrode may exit the cartridge via the open door without interference. Another way of stating that the door is larger than the electrode is to say that the area (e.g., surface area) of the door is greater than the greatest cross-sectional area of the electrode. In an implementation in which the body of the electrode is cylindrical, the circumference of the door is greater than the circumference of the cylinder. Further, because the electrode is positioned in the bore and exits the bore, the area of the door may be about the same or greater than the area of the opening of the bore.

The frangible portion of the cover may be manufactured for repeatable (e.g., predictable, consistent) rupture by the opener over many different cartridges and normal manufacturing variations. The characteristics of the frangible portion that provide repeatable rupture include the type of material that forms the frangible portion, consistency of material thickness at the point most likely to rupture, consistency of physical dimensions of the frangible portion, physical dimensions of the door, the shape of the frangible portion, and/or proximity of the frangible portion to the door.

The shape and interaction of the opener with the frangible portion further provides repeatability in rupturing the frangible portion to open the door. The repeatability of rupturing the frangible portion of the cover improves the accuracy of launch, flight, and delivery of an electrode to a target.

A housing may be shaped for inserting, at least partially, into a bay of a handle. A housing may include structures (e.g., levers) for interfering with one or more portions of the bay for retaining (e.g., holding) the cartridge in the bay. The structures of the housing that interfere with the one or more portions of the bay may be moved by a user to a position where they no longer interfere with portions of the bay so that the cartridge may be removed from the bay.

A housing may include a coupler that comes into physical contact with a coupler of the handle while the cartridge is inserted into a bay. Physical contact of the coupler on the housing and the coupler on the handle establishes an electrical connection between the handle and the cartridge. Removing the housing from the bay separates the coupler on the housing from the coupler on the handle thereby terminating physical and electrical coupling between the cartridge and handle. A coupler may be used to provide electrical communication, unidirectional and/or bidirectional, between a handle and a cartridge. A coupler may be used to provide power, data, addresses, control signals, and/or a stimulus signal between the handle and cartridge.

A filament (e.g., tether, wire, wire-tether) conducts a current. A filament may be formed of a conductor (e.g., wire) that is insulated or uninsulated. A filament electrically couples a signal generator to an electrode. A filament may electrically couple to a signal generator via circuit that includes a coupler of the cartridge and a coupler of the handle. A filament carries a current at a voltage for ionizing air in one or more gaps and impeding locomotion of a target. A filament mechanically couples to an electrode. A current pulse at a voltage from the signal generator may electrically couple a filament to an electrode. A filament mechanically couples to a cartridge. A filament deploys from a cartridge upon launch of an electrode to extend (e.g., stretch, deploy) between the cartridge in a handle and a target. A filament is positioned in a cartridge prior to deployment of the electrode that is mechanically coupled to the filament.

An electrode, as discussed above, couples to a filament and is launched toward a target to deliver a current through the target. An electrode may include aerodynamic structures to improve accuracy of flight from a CEW toward the target. An electrode may include structures (e.g., spear, barbs) for mechanically coupling to a target. Movement of an electrode out of a cartridge toward a target applies a force (e.g., pull) on a filament to deploy the filament so that it extends from the cartridge to the electrode at the target. An electrode may be formed in whole or part of a conductive material for delivering the current into target tissue.

An electrode may include structures for receiving a force provided by the propellant to launch the electrode. An electrode may include structures for providing a force to an opener to open a door of a cover of the cartridge. An electrode may be formed, at least in part, of a rigid material that permits translation of the force from the propellant to the opener via the electrode.

As discussed above, a cartridge may include a coupler (e.g., connector, interface) that electrically couples (e.g., connects) the cartridge to a handle and to a signal generator of the handle. A coupler may couple the cartridge to a power supply of the handle. A coupler may couple the cartridge to a processing circuit of the handle. One end of a filament in a cartridge may be coupled, directly or indirectly, to the signal generator of the handle. The current provided by the signal generator may be provided to the cartridge then to the target via the couplers in the bay and on the cartridge, a filament and an electrode. The processing circuit of the handle may communicate with a cartridge via the coupler. A processing circuit may provide signals via the coupler to a cartridge for launching electrodes. Upon removing a cartridge from the bay of the handle, the coupler of the cartridge separates from the coupler of the handle to permit removal of the cartridge from the bay of the handle. Insertion of a new cartridge into the bay electrically couples the coupler of the cartridge unit to the handle.

A propellant propels one or more electrodes from a cartridge toward a target. A propellant applies a force (e.g., a rapidly expanding gas) on a surface of the one or more electrodes to push the one or more electrodes from the cartridge toward the target. A propellant provides the force that opens a door of the cover of cartridge to permit exit of an electrode from the cartridge. The force applied to the one or more electrodes is sufficient to open the doors of the cover, accelerate the electrodes to a velocity suitable for traversing a distance to a target and for striking the target, for deploying the respective filaments coupled to the electrodes, and for coupling, if possible, the electrodes to the target. The force of a propellant may be provided by burning a pyrotechnic, releasing a compressed gas, or any combination thereof.

A propellant may be activated (e.g., initiated) by an electrical signal. A propellant may be activated mechanically (e.g., movement of firing pin). An electrical signal that activates a propellant may be provided under the control of a processing circuit. Movement of a mechanical structure to mechanically activate a propellant may be under the control of a processing circuit. A processing circuit of a handle may control and/or provide a signal used to activate a propellant in a cartridge. A processing circuit of a handle may activate a propellant of a cartridge responsive to an action (e.g., trigger pull) taken by a user of the CEW.

In an implementation, handle 1110 and cartridges 1120 and 1130 perform the functions of a handle and cartridges discussed above. Trigger 1140, safety 1142, processing circuit 1160, power supply 1150, and signal generator 1170 perform the functions of a trigger, a safety, a processing circuit, a power supply, and a signal generator respectively as discussed above. Cartridge 1120, which includes, inter alia, filaments 1122 and 1126, and electrodes 1124 and 1128, perform the functions of a cartridge, filaments, and electrodes respectively as discussed above. Cartridge 1130, which includes, inter alia, filaments 1132 and 1136, and electrodes 1134 and 1138 perform the functions of a cartridge, filaments, and electrodes respectively as discussed above.

Power supply 1150 provides energy to signal generator 1170 to provide a current (e.g., stimulus signal) through target tissue to impede locomotion of the target. Power supply 1150 provides energy to trigger 1140, safety 1142, processing circuit 1160, and signal generator 1170 for the operation of these components. Power supply 1150 may also provide power to electronic/electrical components of cartridge 1120 and 1130 for the operation of those components. Power busses between components are not shown. Power supply 1150 includes any conventional device. Power supply 1150 may include a battery.

Trigger 1140 and safety 1142 include physical structures, electronic devices, and/or electromechanical devices so that a user may provide information and/or commands to CEW 1100. Physical structures, electronic devices, and/or electromechanical devices for a user to provide information to CEW 1100 include one or more controls as discussed above.

CEW 1100 may provide information to a user via a display (e.g., LCD, touch screen) that presents information, via audible sounds (e.g., a speaker, buzzer), and/or a haptic (e.g., vibration) device.

CEW 1100 may include a communication circuit (e.g., transceiver) for local wireless communication (e.g., BLUETOOTH®, BLUETOOTH® Low Energy (BLE), ZIGBEE®) with an electronic device (e.g., smart phone, tablet). The electronic device may receive and present on its display information from CEW 1100 for the user to read and/or hear. A user may use a touch screen of the electronic device to provide information to CEW 1100 thereby moving some functions of a user interface to the electronic device via the communication link.

Trigger 1140 and safety 1142 may provide a notice (e.g., electrical signal) to processing circuit 1160 responsive to operation by a user. Processing circuit 1160 may take an action responsive to a notice.

Processing circuit 1160 controls and/or coordinates the operation of CEW 1100. Processing circuit 1160 may control and/or coordinate the operation of some or all aspects of the operation of handle 1110, cartridge 1120, and/or cartridge 1130. In an implementation, processing circuit 1160 includes a microprocessor that executes a stored program. Processing circuit 1160 includes memory that stores the executable program. The microprocessor includes input ports, output ports, and/or data busses for communication with trigger 1140, safety 1142, signal generator 1170, and/or cartridges 1120 and 1130 to receive notices and/or information and to provide information and/or control signals.

Processing circuit 1160 receives notices from trigger 1140 and safety 1142. Processing circuit 1160 performs the functions of CEW 1100 responsive to notices from trigger 1140 and/or safety 1142. Processing circuit may control the operation, in whole or part, of signal generator 1170, cartridge 1120, and/or cartridge 1130 to perform an operation of CEW 1100.

For example, a user may operate trigger 1140, while safety 1142 is off, to indicate the user's desire to deliver a stimulus signal to a target. Processing circuit 1160 may receive the notice from trigger 1140 regarding the operation of trigger 1140. Responsive to the notice, processing circuit 1160 may instruct and/or control cartridge 1120 and/or cartridge 1130 to launch electrodes and signal generator 1170 to provide a stimulus signal.

Processing circuit 1160 may further receive information from the other components (e.g., devices) of handle 1110 and cartridges 1120 and 1130 regarding performance of an operation. For example, processing circuit 1160 may receive information from signal generator 1170 regarding the stimulus signal, such as information regarding voltage, charge, current, and/or communication with cartridges 1120 and 1130. Processing circuit 1160 may use received information to control delivery of future stimulus signals. Processing circuit 1160 may receive information from cartridge 1120 and/or 1130 regarding deployment. Processing circuit 1160 may use any or all received information to control a future operation of CEW 1100.

Processing circuit 1160, handle 1110, cartridge 1120, and/or cartridge 1130 may communicate information and/or control signals in any conventional manner using any conventional structures such as traces (e.g., conductors, wires, PCB traces) for signals, serial communication links, and/or parallel busses for address and/or data. Because cartridges 1120 and 1130 may be decoupled from handle 1110, handle 1110 and cartridges 1120 and 1130 may include couplers (e.g., connectors) that connect the traces, links, and/or busses of handle 1110 to the traces, links, and/or busses of a cartridge upon insertion of the cartridge into a bay. Conversely, removing a cartridge from a bay decouples (e.g., disconnects) the traces, links, and/or busses of handle 1110 from the traces, links, and/or busses of the cartridge. A coupler on cartridge 1120, cartridge 1130, and/or handle 1110 may include any coupler including any conventional coupler.

For example, cartridge 1120 and cartridge 1130 are inserted into bay 1180 and 1190 respectively in handle 1110. Inserting cartridge 1120 into bay 1180 couples cartridge 1120 to handle 1110 so that filament 1122, electrode 1124, filament 1126, and electrode 1128 may electrically couple to signal generator 1170. Inserting cartridge 1130 into bay 1190 couples cartridge 1130 to handle 1110 so that filament 1132, electrode 1134, filament 1136, and electrode 1138 may electrically couple to signal generator 1170.

A coupler between handle 1110 and cartridge 1120 and/or 1130 respectively may also be used to removably establish a path for providing a stimulus signal from signal generator 1170 to a target via the filaments and electrodes of cartridges 1120 and/or 1130.

Figure 11:
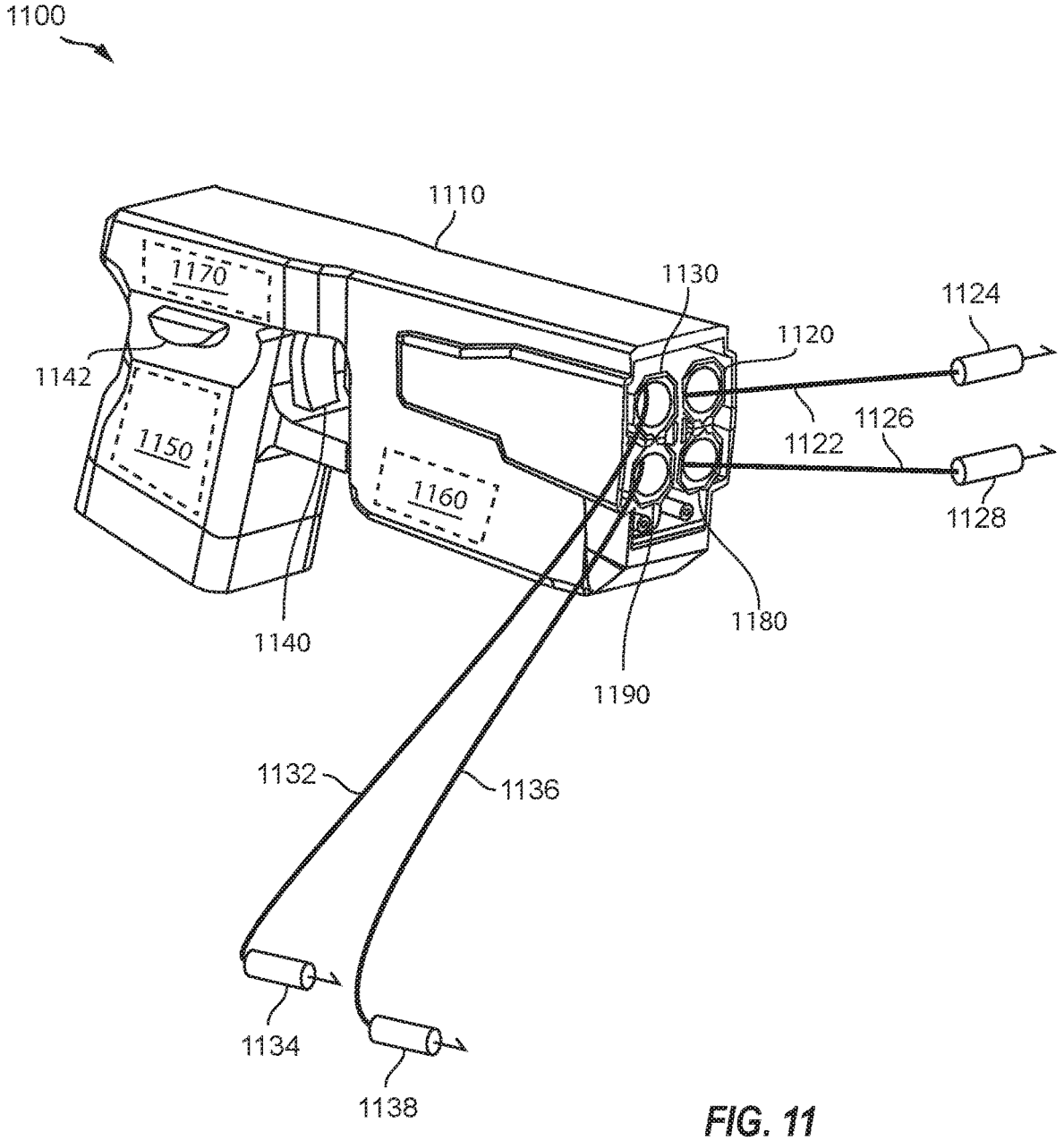
FIG. 11 is a perspective diagram of an implementation of a CEW according to various aspects of the present invention.

The direction of travel of electrodes 1134 and 1138 in FIG. 11 is not in line (e.g., consistent) with forward deployment from cartridge 1130 as would occur in normal operation. The positions of electrodes 1134 and 1138 relative to handle 1110 and cartridge 1130 were chosen to provide clarity for discussion of FIG. 11.

Signal generator 1170 receives energy from power supply 1150, control signals from processing circuit 1160 and provides the stimulus signal to electrodes 1124 and 1128 via filaments 1122 and 1126, and/or electrodes 1134 and 1138 via filaments 1132 and 1136. Signal generator 1170 receives control signals from processing circuit 1160 to set the characteristics of the stimulus signal. For example, a stimulus signal may be provided as a series of current pulses. Processing circuit 1160 may control the operation of signal generator 1170 to deliver a stimulus signal that has a certain number of current pulses, current pulses at a pre-determined number of pulses per second, current pulses that provide a pre-determined amount of current per pulse or stimulus signal, and/or a predetermine duration of time (e.g., 5 seconds) for delivering current pulses.

In an implementation of a cartridge, according to various aspects of the present invention, cartridge 100 as shown in FIGS. 1-9 performs the functions and/or includes the structures of a cartridge as discussed above.

Cartridge 100 includes body 110, cap 120, cap 130, propellant 250, electrode 212, electrode 232, opener 214, and opener 234. Body 110 includes rear portion 112, forward portion 114, protrusion 154, protrusion 164, lever 140, lever 142, bore 210, bore 230, duct 218, and chamber 260. Electrode 212 includes spear 216, body 228, and a filament (not shown). Electrode 232 includes spear 236, body 238, and a filament (not shown).

Body 110 performs the functions of a housing as discussed above. Lever 140 and lever 142 respectively perform the functions of a lever as discussed above. Bore 210 and bore 230 respectively perform the functions of a bore as discussed above. Propellant 250 performs the functions of a propellant as discussed above. Electrode 212 and electrode 232 respectively perform the functions of an electrode as discuss above. A filament performs the functions of a filament as discussed above. Opener 214 and opener 234 perform the functions of an opener as discussed above.

Cap 120 includes cover 122, opening 162, opening 564, holes 510, 512, 610, and 612, edges 620 and 622, surface 624, and opening 640. Cover 122 includes frangible portion 124, door 126, rear ring 522, and columns 530, 532, and 912. Cover 122, frangible portion 124, and door 126 perform the functions of a cover, a frangible portion, and a door respectively as discussed above.

Cap 130 includes cover 132 and opening 152. Cap 130 is the same as cap 120 and also includes holes, edges, a surface, and an opening even though those aspects of cap 130 are not shown in the drawing. Cover 132 includes frangible portion 134 and door 136. Cover 132 is the same as cover 122 and also includes a rear ring and columns even though those aspects of cover 132 are not shown in the drawing. Cover 132, frangible portion 134, and door 136 perform the functions of a cover, a frangible portion, and a door respectively as discussed above.

Propellant 250 includes needle 252, canister 254 and primer 256. Needle 252 includes duct 258. Propellant 250 performs the functions of a propellant as discussed above.

Protrusion 154 and opening 152 cooperate to form latch 150. Protrusion 164 and opening 162 cooperate to form latch 160. While protrusion 154 is positioned in opening 152, a side portion of opening 152 interferes with (e.g., contacts, touches) protrusion 154 thereby prohibiting cap 130 from moving. Likewise, while protrusion 164 is positioned in opening 162, a side portion of opening 162 interferes with (e.g., contacts, touches) protrusion 164 thereby prohibiting cap 120 from moving. Accordingly, latch 150 holds cap 130 and latch 160 holds cap 120 on forward portion 114 of body 110. Latch 160 and latch 150 respectively retain cap 120 and cap 130 coupled to forward portion 114 before, during, and after use of cartridge 100. Cap 120, cap 130, and body 110 may include other structures (e.g., additional holes, protrusions, opening 564) for holding cap 120 and/or cap 130 on body 110.

Levers 140 and 142 are formed of a resilient material. As cartridge 100 is inserted into a bay of a handle (e.g., handle 1110), levers 140 and 142 are pressed inward toward body 110 by an inner surface of the bay until protrusion 144, and an analogous protrusion on lever 140, enters a void (e.g., channel) in the inner surface of the bay and levers 140 and 142 move away from body 110. While protrusion 144 is positioned in the void, protrusion 144 interferes with a side of the void to retain cartridge 100 in the bay of the handle. Cartridge 100 may be removed from the bay by pressing lever 140 and lever 142 toward body 110 so that protrusion 144, and the analogous protrusion on lever 140, exit the void so that cartridge 100 may be extracted (e.g., pull) from the bay.

A body provides structure (e.g., walls, chambers, bores, openings, protrusions, levers, latches) for positioning the parts (e.g., components) of a cartridge. A body provides structure for facilitating cooperation of parts of the cartridge to perform the functions of a cartridge. A body provides outer structure of an appropriate shape and/or size for positioning the cartridge in a bay of a handle. A body protects the components of a cartridge during storage, transport, and/or use.

A duct (e.g., pipe, tube, channel) may provide fluid (e.g., air, gas) communication between two areas (e.g., chambers). A duct may direct (e.g., steer) a flow of fluid. A duct may direct a flow of fluid into an area so that the fluid may press against an object positioned in the area.

An electrode may be positioned in a bore. A bore may retain (e.g., hold) an electrode until launch. A bore may establish a flight path (e.g., trajectory), at least initially, of an electrode at launch. A bore may be in fluid communication, via a duct, with a propellant. A bore may receive a flow of fluid from the propellant and direct the force of the flow of fluid, directly or indirectly, against an electrode to launch the electrode from the bore. A bore may retain an opener. A bore may retain an opener positioned forward of an electrode while an opener is positioned in the bore. A bore may position an opener for opening a door of a cover of the cartridge. A bore may direct the force of a fluid flow, directly or indirectly, to move an opener against the cover to open the door.

An opener (e.g., ejector, cutter) may cooperate with a cover and an electrode to open a door of the cover. An opener may open a door of a cover at launch of an electrode from the cartridge via the open door. An opener may apply a force against an interior (e.g., inner, inside) surface of a cover to open the door of the cover. After opening a door of a cover, an opener may exit the cartridge via the door. An opener may exit the cartridge in advance (e.g., ahead of) the electrode. An electrode may push (e.g., move) an opener to open the door of the cover. An electrode may push an opener out of a bore of a cartridge via an open door. An electrode may push an opener away from a cartridge.

An opener may be formed of two or more parts. The parts of an opener may separate from each other after opening the door of a cover. Upon exiting a cartridge, the parts of an opener may fall away from the flight path of the electrode, so as to not interfere with the flight of an electrode toward a target. An opener, or the parts thereof, may have structures (e.g., shape, ridges, edges, openings) that cooperate with air resistance as the opener moves out of and away from the cartridge so as to move the opener away from the electrode and out of the flight path of the electrode. The weight of an opener, as compared to the weight of an electrode may be such (e.g., lighter) so as to promote (e.g., encourage, facilitate, result in) movement of the opener away from the electrode and out of the flight path of the electrode during launch of the electrode.

An opener may push (e.g., move) a door, after opening (e.g., removing) the door, away from the cartridge. An opener may push a door away from an electrode and the flight path of the electrode. A door may be formed of a material and/or have a weight (e.g., mass) that promotes movement of the door away from an electrode and out of the flight path of an electrode responsive to air resistance.

An opener may have structures for facilitating the opening of a door of a cover. An opener may include structures for cutting, ripping, tearing, rupturing, separating, and/or puncturing the material of a cover to open a door of a cover. An opener may be shaped for opening a door of a specific size and/or shape. The structures of an opener may cooperate with structures of a cover (e.g., frangible portion) to open a door of the cover. Opening a door may include completely separating the door from the cover. Separation of a door from the cover may occur along a frangible portion of the cover. Opening a door may include moving a door that has been completely separated from the cover away from the cover and/or the cartridge. Completely separating a door from a cover reduces the likelihood that the door will recoil from the force applied by the opener to open the door to strike the opener, electrode, and/or filament thereby improving accuracy of the flight of the electrode toward a target.

A door of a cover may be positioned over an end of a bore so that upon opening (e.g., removing) the door, the end of the bore is exposed. The door may have a size and/or shape that permits (e.g., facilitates, does not impede) movement of an opener and an electrode out of the bore and through the opening where the door was positioned prior to being opened.

A spear facilitates mechanically coupling an electrode to target tissue. A spear may include structures (e.g., barbs) for retaining the mechanical connection of an electrode to target tissue. A spear facilitates piercing target tissue and/or clothing over the target to mechanically couple an electrode in or near target tissue.

A body of an electrode contributes to a shape of the electrode. The shape of a body of an electrode may contribute to the aerodynamic characteristics of an electrode. A body of an electrode may contribute to the weight (e.g., mass) of an electrode.

A body of an electrode may include a cavity. A cavity in the body of an electrode may store a filament for electrically coupling the electrode to the cartridge and in turn to the handle and/or signal generator. One end of a filament positioned in a cavity of an electrode may mechanically couple to the electrode. The other end of the filament positioned in a cavity of an electrode may mechanically couple to the cartridge. As an electrode exits (e.g., leaves) a cartridge, the filament positioned in the cavity of the electrode plays out (e.g., unspools, deploys) from the cavity to extend from the cartridge to a target.

A body of an electrode may receive a propelling (e.g., pushing, moving) force of a propellant. An electrode may move responsive to the force provided by the propellant. A body of an electrode may translate the propelling force of a propellant into movement of the electrode. A body of an electrode may translate a propelling force into forward movement of the electrode. A force provided by a propellant may act on an electrode and in particular a body of the electrode, to move the electrode. A body of an electrode may transfer a force of a propellant to another object. A body of an electrode may transfer the force from the propellant to an opener. As an electrode moves, the body of the electrode may push on another object to move the other object. A body of an electrode may push on an opener. In turn, an opener may push on a cover of the cartridge. A body of an electrode may move an opener so that the opener performs the function of opening a door of a cover. A body of an electrode may move an opener and/or a door so that the door moves away from the cartridge and the opener exits (e.g., leaves) the cartridge via the opening (e.g., aperture, doorway, portal) left by opening the door. A body of an electrode may move an opener and/or a door through air so that the resistance of the air moves the opener and the door out of the flight path of the electrode.

A propellant, as discussed above, may be a combination of a pyrotechnic and a compress gas. A primer includes a pyrotechnic. A primer may be electrically ignited. Ignition of a primer results in a chemical reaction (e.g., burning) that provides a rapidly expanding gas. The rapidly expanding gas from a primer may be directed against a canister. The force of the expanding gas from the primer may be used to move the canister.

A canister contains (e.g., encloses, holds) a compressed gas. While the canister is closed (e.g., sealed), the compressed gas remains compressed and inside the canister. Opening the canister releases the compressed gas. A compressed gas exits an opened canister as a rapidly expanding gas. The rapidly expanding gas from a canister may be directed (e.g., aimed, channeled) against an electrode to launch (e.g., move) the electrode. The rapidly expanding gas from a canister may provide a force for moving an electrode and an opener. The rapidly expanding gas from a canister may provide a force for opening a door and moving the opener and electrode out of the door via the doorway.

A needle may be used to open (e.g., pierce) a canister. A needle may pierce a canister to release a compressed gas from a canister. A needle may include a duct. A duct of a needle may direct a flow of a rapidly expanding gas from the canister. A duct of a needle may provide fluid communication to one or more other ducts. A duct of a needle in cooperation with one or more other ducts may direct the rapidly expanding gas from the opened canister against one or more electrodes. The force of the rapidly expanding gas from an opened canister may launch the electrodes away from the cartridge and toward a target.

A canister provides a rapidly expanding gas to launch one or more electrodes a single time. Once a canister has been opened and the compressed gas released, the canister cannot provide any more rapidly expanding gas to launch further electrodes. Piercing a canister expends (e.g., uses, fires) a cartridge so that it cannot provide further uses. A cartridge with an expended canister may be removed from the handle. A new cartridge in which the canister has not been expended may be inserted into a handle to launch further electrodes.

In an implementation, cartridge 100 is suitable for inserting into a bay of a handle for launching electrodes 212 and 232 toward a target to provide a current through the target to impede locomotion of the target. Rear portion 112 of body 110 is of a suitable shape and size to be inserted into a bay of a handle. Body 110 is of a suitable shape and size to contact (e.g., touch, couple to) one or more inner surfaces and/or structures of a bay to electrically and mechanically couple cartridge 100 to the handle. At least a portion of forward portion 114 extends out of a bay and the forward portion of the handle to permit electrodes 212 and 232 to be launched from cartridge 100 toward a target.

As discussed above, levers 140 and 142 removably couple cartridge 100 to a handle for operation of cartridge 100 to launch electrodes 212 and 232 and to provide a current through a target to impede locomotion of the target.

As discussed above, latch 160 and latch 150, along with other possible latches, coupled cap 120 and cap 130 to forward portion 114 of body 110. Cap 120 and cap 130 are coupled to body 110 during manufacture. In normal operation, latch 160, latch 150, or any other latches are not unlatched (e.g., disengaged) to remove cap 120 and cap 130 from body 110. In normal operation, cap 120 and cap 130 are coupled to body 110 and remain coupled to body 110 during storage, transportation, use, and even after use of cartridge 100.

In manufacture and before caps 120 and 130 are coupled to body 110, an end portion of bore 210 and 230 is open and accessible at the forward portion of body 110. The open end of bores 210 and 230 provide access to insert electrode 212 and electrode 232 into bore 210 and 230 respectively. The open end of bores 210 and 230 provide access to couple one end of a filament (not shown) to body 110. The open end of bores 210 and 230 provide access to insert openers 214 and 234 into bore 210 and bore 230 respectively in a position that is forward of electrode 212 and electrode 232 respectively.

Cap 120 may be positioned and coupled to body 110 independently of and separately from cap 130 and vice versa. A portion of cap 120 and/or cover 122 may contact (e.g., press against) opener 214 to hold (e.g., retain, maintain) opener 214 and in turn electrode 212 in bore 210. A portion of cap 130 and/or cover 132 may contact (e.g., press against) opener 234 to hold (e.g., retain, maintain) opener 234 and in turn electrode 232 in bore 230.

Cap 120 and cap 130 may position cover 122 and cover 132 respectively so that opener 214 and opener 234 are positioned proximate to frangible portions 124 and 134 respectively and/or doors 126 and 136 respectively.

Cap 120 and cap 130 include cover 122 and cover 132 respectively. Cover 122 covers (e.g., lays over, spread over) a majority of the forward portion of cap 120. A significant portion of the forward portion of cap 120 includes opening 640 so that the front portion of cap 120 is open (e.g., has a passage). When launched, electrode 212 exits bore 210 and cartridge 100 via opening 640. Cover 122 spans from one side of opening 640 to the other side of opening 640 such that a large portion of cover 122, including frangible portion 124 and door 126, does not contact the structure of cap 120. Similarly, a significant portion of the forward portion of cap 130 is open (e.g., has a passage), so cover 132 spans from one side of the opening to the other side of the opening such that a large portion of cover 132, including frangible portion 134 and door 136, does not contact the structure around the outer edge of the front portion of cap 130.

The structure around the outer edge of the front portion of cap 120, a similarly cap 130 although not shown, includes edge 622 of opening 640, surface 624, holes 510, 512, 610, and 612, and edge 620. Edge 622 establishes the edge of opening 640. Edge 622 of opening 640 and surface 624 cannot interfere with (e.g., block) opener 214 and electrode 212 as opener 214 and electrode 212 are pushed out of bore 210 and away from cartridge 100. In this implementation, the diameter of opening 640 and thus the diameter of edge 622 are greater than the diameter of opener 214 and electrode 212, so that opener 214 and electrode 212 may pass through opening 640 without contacting edge 622. Edge 620 in this implementation defines the outer edge of cover 122.

Cover 122, and similarly cover 132, are made of a flexible (e.g., pliable, supple), yet breakable (e.g., capable of snapping, break suddenly) material so that application of a force on cover 122 breaks a portion of cover 122, in this case frangible portion 124, as opposed to the force elongating the material of cover 122 before cover 122 breaks to separate door 126 from cover 122. Further, the material of covers 122 and 132 must be suitable for adhering to cap 120 so that cover 122, and similarly cover 132, may be molded over (e.g., over-molded) and onto the material of cap 120.

In an implementation, cover 122 is formed of rubber, a synthetic latex, a thermoplastic elastomer ("TPE"), vulcanized rubber, or a thermoset rubber. In an implementation, cover 122 is formed of a thermoplastic elastomer such a thermoplastic volcanizates (e.g., Santoprene 8211-55B100).

Cover 122 is formed by injecting (e.g., adding, providing) the material of cover 122 so that the material enters and fills (e.g., coupling structure, columns, 530, 532, 912) holes 510, 512, 610, and 612. The material further forms rear ring 522 on an inward side of the front portion of cap 120 around and behind holes 510, 512, 610, and 612. The material of cover 122 spans opening 640 to close off opening 640. The material of cover 122 covers the front portion of cap 120 and surface 624 up to edge 620. Interference (e.g., contact) between rear ring 522 and the inner surface of the front portion of cap 120 and columns 530, 532, and 912 with the edges of holes 510, 512, 610, and 612 holds cover 122 in place and mechanically attached to cap 120. The diameter of rear ring 522 is also large enough to not interfere with opener 214 and electrode 212 as they exit cartridge 100.

The material of cover 122 adheres (e.g., sticks, holds, fastens) to the material of cap 120. In an implementation, cap 120 is formed of Bayblend T85 XF, a polycarbonate/ABS plastic blend, and cover 122 is formed of Santoprene 8211-55B100, which adheres to the Bayblend material. Although the material that forms door 126 and frangible portion 124 do not contact the material of cap 120, the edges of cover 122 and other portions do contact the material of cap 120. Because the material of cover 122 adheres to the material for cap 120, cover 122 may operate to keep debris, moisture, and/or grime from enter cartridge 100.

As the material that forms cover 122 is added to the front portion of cap 120, frangible portion 124 and door 126 may be formed. The material used to form cover 122 may be a uniform thickness across opening 640 or it may have different thicknesses. In an implementation, a portion of cover 122 has a thickness that is less than the thickness of other portions of cover 122. In particular, thickness 810 of frangible portion 124 is less than thickness 812 of door 126.

In an implementation that uses a type of thermoplastic volcanizates (e.g., Santoprene 8211-55B100), thickness 812 of door 126 is $^{30}/_{1000}$+/−$^{5}/_{1000}$ inches while thickness 810 of frangible portion 124 is $^{10}/_{1000}$+/−$^{5}/_{1000}$ inches. A range for thickness 810 includes $^{5}/_{1000}$ inches to $^{15}/_{1000}$ inches. A range for thickness 812 includes $^{20}/_{1000}$ inches to $^{40}/_{1000}$ inches, preferably $^{25}/_{1000}$ inches to $^{35}/_{1000}$ inches. Formation of frangible portion 124, and in particular thickness 810, may be done in a control manner such that thickness 810 varies only between $^{1}/_{1000}$ to $^{5}/_{1000}$ inches over many cartridges. The decreased thickness of frangible portion 124 increases the repeatability of rupturing frangible portion 124 open and removing door 126 from cover 122 as discussed above. Opener 214 presses against frangible portion 124 and/or door 126 so that the material ruptures to remove door 126 from cover 122 leaving an opening for opener 214 and electrode 212 to exit the cartridge.

In addition to adjusting thickness 810 to facilitate opening and removing door 126, the profile of the change in thickness from thickness 812 down to thickness 810 then from thickness 810 up to thickness 812 may be varied to facilitate removal of door 126. For example, in an implementation frangible portion 124 is like a groove in cover 122. The sides of the groove may be varied in pitch (e.g., slope) to provide consistent removal of door 126 over many cartridges.

Opener 214 cooperates with frangible portion 124, and similarly opener 234 with frangible portion 134, to break (e.g., rupture, tear, cut, separate) frangible portion 124 to remove door 126 from cover 122. Operation of the trigger of the CEW, ignites primer 256 to produce an expanding gas that presses (e.g., pushes, operates) on the rear portion of canister 254. The force from the expanding gas from primer 256 pushes canister 254 against needle 252 so that edge of needle 252 punctures canister 254 and cuts it open. As canister 254 opens, the compressed gas begins to rapidly exit canister 254. The expanding gas from canister 254 moves through duct 258 into duct 218. Duct 218 direct the expanding gas from canister 254 to a rear opening in bore 210, and similarly a rear opening in bore 230. The expanding gas enters bore 210 and presses against the rear portion of electrode 212.

A wad may be positioned between the rear opening of bore 210 and the rear portion of electrode 212 to reduce the amount of expanding gas that escapes (e.g., bypasses) between the outer surface of body 228 and the inner surface of bore 210.

As the expanding gas presses against the wad and the wad against the rear portion of electrode 212, the front portion of electrode 212 presses against opener 214. In turn, opener 214 presses against cover 122 and applies a force (e.g., stress, pressure) on frangible portion 124 and/or door 126. Cover 122 and frangible portion 124 have some strength to resist the pressure applied by opener 214, so frangible portion 124 does not break with the application of the slightest pressure. As force from the expanding gas from canister 254 increases, the force on electrode 212, opener 214, and cover 122 also increases.

At some point, the force applied by opener 214 on cover 122 breaks (e.g., ruptures, cuts, severs, separates) frangible portion 124. Preferably, opener 214 breaks frangible portion 124 around the entire perimeter (e.g., circumference, boundary, outer limit, periphery) of door 126. Preferably, no portion of door 126 and/or frangible portion 124 remains attached to cover 122. Any attachment that remains between door 126 and/or frangible portion 124 and cover 122 may allow door 126 to recoil and strike (e.g., hit) projectile 212 as it is exiting cartridge 100. Contact between door 126 and electrode 212 as a result of recoil of door 126 may adversely affect the trajectory and accuracy of flight of electrode 212.

Opener 214 completely separates door 126 from cover 122. Opener 214 moves door 126 away from cartridge 100 as opener 214 is pushed out of cartridge 100 by electrode 212. As door 126 moves away from cartridge 100, door 126 is subject to air resistance and gravity. Air resistance and gravity acting against door 126 causes door 126 to fall away from opener 214 and/or electrode 212 and out of the flight path of electrode 212.

As opener 214 moves away from cartridge 100, opener 214 is also subject to air resistance and gravity. In a preferred implementation, opener 214 is formed of at least two parts that separate, in response to air resistance, shortly after opener 214 exits cartridge 100. Opener 214 then falls away from electrode 212 and out of the flight path of electrode 212.

Electrode 212, and similarly electrode 232, continues along its flight path toward a target. If the CEW was accurately aimed, electrode 212, and similarly electrode 232, traverses the distance between the CEW and the target, couples in or near target tissue, and delivers a current through target tissue that impedes the locomotion of the target.

Figure 12:
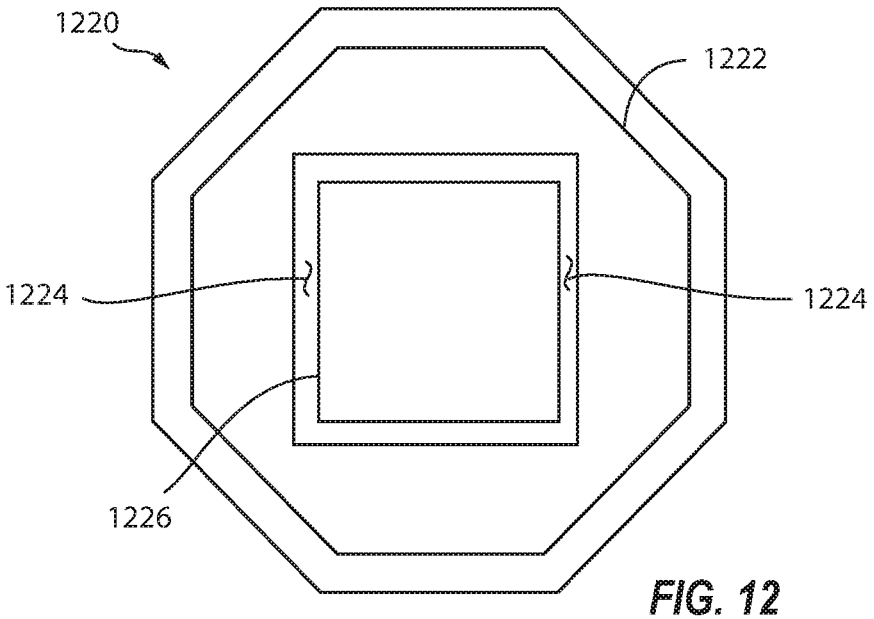
FIG. 12 is a front view of a cap with another implementation of a cover that includes a door and frangible portions.

The shape of door 126 and frangible portion 124 are not limited to a circular shape as shown in FIGS. 1-5 and 8-9. Cap 1220 of FIG. 12 shows cap 1220 and cover 1222. Cover 1222 includes door 1226 and frangible portions 1224. Cap 1220 and cover 1222 perform the functions of a cap and cover as discussed above. Door 1226 and frangible portions 1224 perform the functions of a door and frangible portion discussed above.

Door 1226 of cover 1222 has a square shape. Frangible portion 1224 is positioned around the perimeter of door 1226. An opener positioned inside a bore of the cartridge may press on the inside surface of door 1225 and/or frangible portion 1224 to break frangible portion 1224 to separate door 1226 from cover 1222 so that an electrode may pass through the opening left by the removal of door 1226 to exit the cartridge. An end portion of an opener used to break frangible portion 1224 and to open door 1226 may have the same shape as door 1226 while the remainder of the opener is circular to fit into the bore of the cartridge.

Upon launch of an electrode, the opener ruptures frangible portion 1224 around the entire perimeter of door 1226. Door 1226 completely separates from cover 1222 and is pushed away from the cartridge by the opener. As door 1226 moves away from the cartridge, it falls out of the flight path of the electrode.

A cover need not include a door that entirely separates from the cover to permit the electrode to exit the cartridge. A cover may include frangible portions that are positioned on the cover. When the frangible portions are broken, the material of the cover between the now broken frangible portions form flaps. The flaps remain coupled to the door during and after launch of the electrode. Movement of the opener and/or the electrode out of the cartridge parts (e.g., separates, pushes apart) the flaps to permit the opener and/or electrode to move out of and away from the cartridge.

Figure 13:
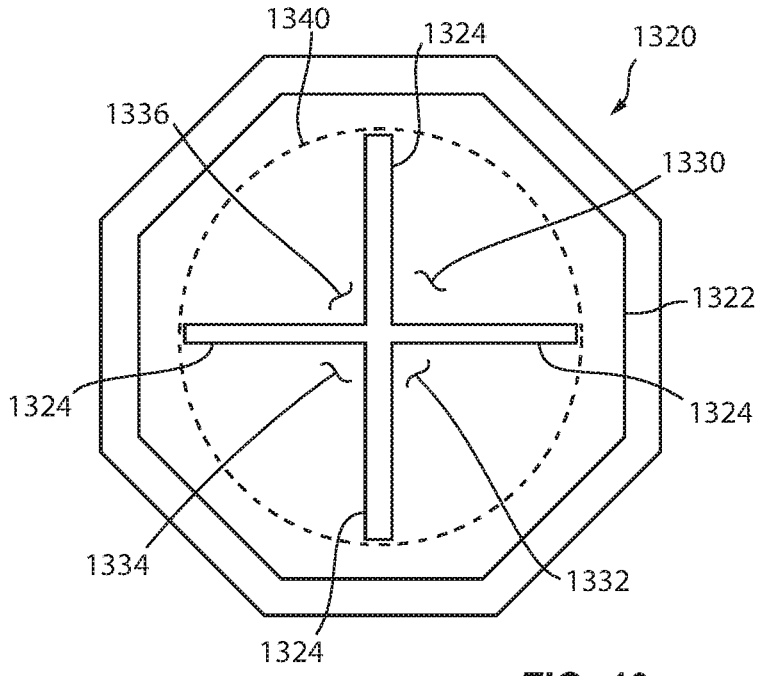
FIG. 13 is front view of a cap with another implementation of a cover that includes frangible portions and flaps.

For example, cover 1322 of cap 1320 includes frangible portion 1324 in the shape of a cross (e.g., an "X"). Cap 1320 of FIG. 13 shows cap 1320 and cover 1322. Cover 1222 includes frangible portions 1224. Cap 1320, cover 1322, and frangible portions 1324 perform the functions of a cap, a cover, and frangible portions respectively as discussed above.

Although the arms of the cross-shaped frangible portion 1324 are positioned vertically (e.g., 90, 270 degrees) and horizontally (e.g., 0, 180 degrees), the arms may be positioned at any angle or orientation (e.g., 45, 135, 225, 325 degrees).

Frangible portions 1324 extend toward the outer edge of cover 1322 so that the portion of the flap that remains coupled (e.g., connected) to cover 1322 after frangible portions 1324 have been ruptured do not interfere with the exit of an electrode from the cartridge. Line 1340 indicates the portion of a flap still coupled to cover 1322 after rupture of frangible portions 1324. The diameter of the circle formed by line 1340 is greater than the diameter of an electrode thereby permitting an electrode to pass (e.g., move, launch) through (e.g., between) flaps 1330-1336 to exit the cartridge. Breaking frangible portions 1324 disengages (e.g., frees) flaps 1330-1336 from each other so that they can move with respect to the remainder of the cover and with respect to the forward portion of the cartridge. Disengaging flaps 1330-1336 from each other by rupturing frangible portions 1324 permits the flaps to move away from each other to permit an electrode to pass between the flaps to exit the cartridge.

The material of cover 1322, as discussed above, is flexible. When an electrode is launched, an opener presses on an inside surface of cover 1322. The force applied by the opener on cover 1322 ruptures frangible portions 1324. As the electrode continues to move forward, the opener begins to part flaps 1330-1336 and the forward portion of the opener begins to pass through (e.g., between) flaps 1330-1336. As the opener and electrode pass through flaps 1330-1336, flaps 1330-1336 brush (e.g., touch, contact) along the outer surface (e.g., sides) of the opener and the electrode. Because flaps 1330-1336 are evenly dispersed around exit 1340, the pressure exerted by flaps 1330-1336 on the opener and the electrode as the brush against the opener and electrode is evenly distributed so the trajectory of the electrode is not altered.

As discussed above, the thickness of the frangible portions that form the flaps is less than the thickness of other portions of the cover so as to permit breaking in a control manner. The material of the cover that form the flaps need not have the same thickness as other portions of the cover. In an implementation, the frangible portions have a first thickness, the material that forms the flaps has a second thickness, and the remaining material of the cover has a third thickness. The first thickness is less than the second thickness and the second thickness is less than the third thickness. In another implementation, the second thickness and the third thickness are about the same and both greater than the first thickness.

The material that forms the flaps need not have a uniform thickness. In an implementation, the thickness of the material of a flap toward the center of the cover where the electrode exits the cartridge is less than the thickness of the material of the flap farther away from the center of the cover.

In another implementation, a flap may be formed by completely disengaging (e.g., disconnecting) a door from the cover, but retaining the door mechanically coupled to the cover so that the door remains mechanically coupled to the cover as the electrode exits through the opening formed by removing the door. For example, door 126 may be mechanically coupled to cover 122 using a thread. Even though door 126 completely disconnects from cover 122 to form an opening for an electrode to exit cartridge 100, door 126 is not pushed away from cartridge 100 and door 126 once frangible portion 124 is ruptured does not fall away under the force of gravity because it is held to cover 122 by the thread. In this implementation, opener 214 ruptures frangible portion 124 to completely disconnect door 126 from cover 122; however, door 126 remains mechanically coupled to cover 122 by the thread. Opener 214 pushes door 126 out of the way as electrode 212 exits from cartridge 100. Door 126 may brush against the side of electrode 212 as electrode 212 exits cartridge 100. Once electrode 212 moves out and away from cartridge 100, door 126 remains coupled to cover 122 by the thread.

In another implementation, door 126 is not completely disconnected from cover 122, but a small portion of door 126 remains coupled to cover 122 while the majority of the perimeter of door 126 is disconnected from cover 122 by rupturing frangible portion 124. The small portion of door 126 that remains coupled to cover 122 causes door 126 to operate as a flap as discussed above.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of components, structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing".

What is claimed is:

1. A cartridge for a conducted electrical weapon, the cartridge comprising:

a body having a first end and a second end, the first end forming an inner perimeter defining an opening to a cavity;

a projectile configured to be propelled from the body via the opening of the cavity; and a cover coupled to the first end of the body covering the cavity, the cover comprising:

a door defining an inner portion of the cover; and a frangible portion comprising a groove in a surface of the cover surrounding and defining the door, wherein the frangible portion is configured to break to decouple the door from the inner portion of the cover and permit the projectile to be propelled through the opening of the cavity.

2. The cartridge of claim 1, wherein a profile of the door is one of a circular, a square, a rectangular, or a stellar profile.

3. The cartridge of claim 1, wherein:

the door has a first thickness;

the frangible portion has a second thickness; and the first thickness is greater than the second thickness.

4. The cartridge of claim 1, further comprising an opener positioned forward of the projectile, wherein the opener is configured to break the frangible portion responsive to a movement by the projectile.

5. The cartridge of claim 1, wherein in response to the door decoupling from the cover an aperture is formed in the cover to permit the projectile to be propelled through the opening of the cavity and the aperture.

6. The cartridge of claim 5, wherein a cross-sectional area of the aperture is less than a cross-sectional area of the opening to the cavity.

7. The cartridge of claim 1, wherein in response to the door decoupling from the cover a remainder of the cover remains coupled to the body.

8. The cartridge of claim 1, wherein one or more sides of the groove are varied in pitch.

9. A cartridge for coupling to a conducted electrical weapon, the cartridge comprising:

a body having a forward portion and an aft portion;

a projectile configured to be launched from the forward portion of the body; and a cover coupled to the forward portion of the body, the cover comprising:

an outer edge;

a frangible portion radially inward from the outer edge; and a door radially inward from the frangible portion, wherein the frangible portion separates the door from the outer edge, and wherein the frangible portion is configured to rupture responsive to a launch of the projectile to decouple the door from the outer edge of the cover.

10. The cartridge of claim 9, further comprising an opener disposed between the projectile and the cover, and wherein the opener is configured to separate the door from the cover in response to the launch of the projectile.

11. The cartridge of claim 10, wherein the opener is configured to rupture the frangible portion in response to the launch of the projectile.

12. The cartridge of claim 11, wherein in response to the launch of the projectile the opener is configured to contact at least one of the frangible portion and the door to rupture the frangible portion.

13. The cartridge of claim 10, wherein the opener is configured to move the door from a flight path of the projectile after the door is decoupled from the cover.

14. The cartridge of claim 10, wherein the opener is configured to separate from a flight path of the projectile in response to the launch of the projectile.

15. The cartridge of claim 10, wherein the projectile comprises a spear coupled to a front surface of the projectile, and wherein a first length of the spear is less than a second length of the opener.

16. The cartridge of claim 10, wherein the opener comprises an end portion having a same shape as the door and a remainder portion having a circular shape.

17. A cartridge for coupling to a conducted electrical weapon, the cartridge comprising:

a body having a first end and a second end, the first end forming an inner perimeter defining an opening to a cavity;

a projectile configured to be launched from the body via the opening of the cavity; and a cover coupled to the first end of the body covering the opening of the cavity, wherein the cover comprises a frangible portion, wherein the frangible portion is configured to break responsive to a launch of the projectile to create a plurality of flaps in the cover, and wherein an area of an exit formed by the plurality of flaps is less than a cross-sectional area of the opening in the cavity.

18. The cartridge of claim 17, wherein in response to the launch of the projectile the plurality of flaps are configured to contact an outer surface of the projectile without impeding a trajectory of the projectile.

19. The cartridge of claim 17, wherein the plurality of flaps are distributed proportionately around a periphery of the projectile.

20. The cartridge of claim 18, wherein the contact of the plurality of flaps applies a force proportionately around a periphery of the projectile, thereby not impeding the trajectory of the projectile.

* * * * *